US009484718B2

(12) United States Patent
Yoshida et al.

(10) Patent No.: US 9,484,718 B2
(45) Date of Patent: Nov. 1, 2016

(54) SPARK PLUG

(71) Applicant: NGK SPARK PLUG CO., LTD., Nagoya-shi, Aichi (JP)

(72) Inventors: Haruki Yoshida, Tajimi (JP); Takamitsu Mizuno, Hashima (JP); Masaaki Kumagai, Aichi (JP); Jumpei Kita, Nagoya (JP); Yoshitomo Iwasaki, Komaki (JP); Toshitaka Honda, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/912,753

(22) PCT Filed: Aug. 8, 2014

(86) PCT No.: PCT/JP2014/071002

§ 371 (c)(1),
(2) Date: Feb. 18, 2016

(87) PCT Pub. No.: WO2015/029749

PCT Pub. Date: Mar. 5, 2015

(65) Prior Publication Data

US 2016/0204580 A1 Jul. 14, 2016

(30) Foreign Application Priority Data

Aug. 29, 2013 (JP) ..... 2013-177628
Feb. 7, 2014 (JP) ..... 2014-022891

(51) Int. Cl.
*H01T 13/20* (2006.01)
*H01T 13/39* (2006.01)
*H01T 13/41* (2006.01)

(52) U.S. Cl.
CPC ..... *H01T 13/39* (2013.01); *H01T 13/41* (2013.01)

(58) Field of Classification Search
CPC ..... H01T 13/39
USPC ..... 313/141
See application file for complete search history.

(56) References Cited

U.S. PATENT DOCUMENTS

2013/0264939 A1 10/2013 Fukushima et al. ..... 315/58

FOREIGN PATENT DOCUMENTS

| | | | |
|---|---|---|---|
| JP | 02-220384 | A | 9/1990 |
| JP | 2005-327743 | A | 11/2005 |
| JP | 2006-066086 | A | 3/2006 |
| JP | 2010-153393 | A | 7/2010 |
| JP | 2012-079562 | A | 4/2012 |
| JP | 2012-129132 | A | 7/2012 |

OTHER PUBLICATIONS

International Search Report issued in corresponding International Patent Application No. PCT/JP2014/071002, dated Sep. 9, 2014.

*Primary Examiner* — Vip Patel
(74) *Attorney, Agent, or Firm* — Kusner & Jaffe

(57) ABSTRACT

A spark plug includes an insulator having an axial hole, a center electrode inserted into a forward portion of the axial hole, a terminal electrode inserted into a rear portion of the axial hole, and an interelectrode insert which contains glass and electrically conductive carbon and is disposed in the axial hole between the center electrode and the terminal electrode. The interelectrode insert has a resistance of 1.0 kΩ to 3.0 kΩ, and the interelectrode insert has a carbon content of 1.5% by mass to 4.0% by mass at a forward portion located forward of a center point between the rear end of the center electrode and the forward end of the terminal electrode. Furthermore, the forward portion is lower in resistance than a rear portion of the interelectrode insert located rearward of the center point.

9 Claims, 5 Drawing Sheets

SPARK PLUG

RELATED APPLICATIONS

This application is a National Stage of International Application No. PCT/JP2014/071002 filed Aug. 8, 2014, which claims the benefit of Japanese Patent Application No. 2013-177628 filed Aug. 29, 2013 and Japanese Patent Application No. 2014-022891, filed Feb. 7, 2014, fully incorporated herein by reference.

FIELD OF THE INVENTION

The present disclosure relates to a spark plug for use in an internal combustion engine or the like.

BACKGROUND OF THE INVENTION

A spark plug is mounted to an internal combustion engine or the like and used for igniting an air-fuel mixture or the like in a combustion chamber. Generally, a spark plug includes an insulator having an axial hole, a center electrode inserted into a forward portion of the axial hole, a terminal electrode inserted into a rear end portion of the axial hole, a metallic shell provided on the outer circumference of the insulator, and a ground electrode fixed to a forward end portion of the metallic shell. Also, a gap is formed between a forward end portion of the center electrode and a distal end portion of the ground electrode, and voltage is applied to the center electrode (gap) for generating spark discharges across the gap, thereby igniting the air-fuel mixture or the like.

Also, in order to restrain radio noise generated in association with operation of an internal combustion engine or the like, a resistor can be provided in the axial hole between the center electrode and the terminal electrode (refer to, for example, Japanese Patent Application Laid-Open (kokai) No. 2006-66086, Japanese Patent Application Laid-Open (kokai) No. 2005-327743, etc.). Generally, the resistor is formed through compressional heating of a resistor composition which contains carbon as an electrically conductive material, glass powder, ceramic particles, etc. The formed resistor contains glass and carbon and is in a state of phase separation in which an interstitial phase composed primarily of molten glass exists around a particulate aggregate phase, and the interstitial phase contains carbon and ceramic particles. The center electrode and the terminal electrode are electrically connected through electrically conductive paths formed of carbon in the interstitial phase.

In recent years, in order to improve ignitability, there has been proposed a spark plug in which an interelectrode insert (including a resistor) disposed between the forward end of the terminal electrode and the rear end of the center electrode has a relatively low resistance. In such a spark plug, since relatively large current flows through the interelectrode insert (resistor) at the time of occurrence of spark discharges, the electrically conductive paths formed in the resistor are likely to have a high temperature. Furthermore, particularly, at the forward portion of the interelectrode insert which is disposed toward a combustion chamber and is particularly likely to have a high temperature in the course of use, coupled with flow of a relatively large current, the electrically conductive paths have a very high temperature, potentially resulting in rapid oxidation. As a result, in the course of use, the resistance of the interelectrode insert (resistor) may abruptly increase. That is, a spark plug having the interelectrode insert of a relatively low resistance encounters difficulty in securing a good under-load life characteristic.

Also, in association with recent tendency toward higher outputs of engines, etc., demand has been rising for further improvement of durability and restraint of radio noise.

The present disclosure has been conceived in view of the above circumstances, and a first advantage thereof is to reliably implement an excellent under-load life characteristic for a spark plug whose interelectrode insert has a relatively low resistance and which thus encounters difficulty in securing a good under-load life characteristic. A second advantage of the present disclosure is to improve restraint of radio noise and the life of a resistor.

SUMMARY OF THE INVENTION

Modes of the present disclosure suitable for implementing, at least partially, the above advantages will next be described in itemized form.

Mode 1. In accordance with a first aspect of the present invention, there is provided a spark plug comprising:

an insulator having an axial hole extending therethrough along an axial line, a center electrode inserted into a forward end side of the axial hole, a terminal electrode inserted into a rear end side of the axial hole, and an interelectrode insert which contains glass and electrically conductive carbon and is disposed in the axial hole between the center electrode and the terminal electrode, and the spark plug is characterized in that the interelectrode insert has a carbon content of 1.5% by mass to 4.0% by mass at a forward portion located forward of a center point along the axial line between a rear end of the center electrode and a forward end of the terminal electrode, the interelectrode insert has a resistance of 1.0 kΩ, to 3.0 kΩ, and the forward portion is lower in resistance than a rear portion of the interelectrode insert located rearward of the center point along the axial line between the rear end of the center electrode and the forward end of the terminal electrode.

According to the above mode 1, the interelectrode insert has a resistance of 1.0 kΩ, or more; thus, when voltage is applied to the center electrode, a relatively large current flows through the interelectrode insert. Therefore, particularly, at the forward portion of the interelectrode insert which has a high temperature, abrupt oxidation of electrically conductive paths formed of carbon is of concern.

In this connection, according to the above mode 1, the carbon content of a forward portion of the interelectrode insert is specified as 1.5% by mass or more. Therefore, electrically conductive paths formed in the forward portion can be sufficiently thick, so that, at the time of application of electricity, heat generated in the electrically conductive paths can be reduced. As a result, oxidation of the electrically conductive paths can be effectively restrained.

Furthermore, according to the above mode 1, the carbon content is specified as 4.0% by mass or less and is thus reduced to such an extent as to be able to sufficiently restrain cohesion of carbon. Therefore, at the forward portion, a sufficient number of electrically conductive paths can be formed. As a result, there can be reliably prevented a situation in which oxidation of a mere portion of electrically conductive paths leads to an abrupt increase in the resistance of the forward portion (interelectrode insert). Particularly, the forward portion of the interelectrode insert is apt to be subjected to heat from a combustion chamber; thus, specifying the carbon content of the forward portion is quite effective. According to the above mode 1, not only is controlled to 3.0 kΩ, or less the resistance, but also the carbon content is specified, whereby durability can be effectively improved.

Notably, if the carbon content is excessively increased, the electrically conductive paths will increase, but the resistance will lower (durability deteriorates). In the present embodiment, a required resistance is attained by relatively reducing the glass content and reducing the carbon content per unit area (reducing carbon density). However, if the glass content is excessively low, increasing the density of the interelectrode insert through deformation of glass will become insufficient, potentially resulting in a failure to implement good durability. Also, if the carbon content is excessively low, the number of the electrically conductive paths having high carbon density will become small, potentially resulting in a failure to implement good durability.

Furthermore, according to the above mode 1, in the interelectrode insert, the forward portion is lower in resistance than the rear portion. Therefore, at the time of application of electricity, heat generated at the forward portion can be further reduced. As a result, oxidation of electrically conductive paths can be more effectively restrained.

As mentioned above, according to the above mode 1, at the forward portion which is apt to have a high temperature and in which oxidation of electrically conductive paths is of greater concern, oxidation of the electrically conductive paths can be very effectively restrained; and, even when the electrically conductive paths are partially oxidized, an abrupt increase in resistance can be more reliably prevented. As a result, an excellent under-load life characteristic can be more reliably implemented for a spark plug which encounters difficulty in securing a good under-load life characteristic because of a resistance of the interelectrode insert of 1.0 kΩ to 3.0 kΩ.

The present invention can be implemented in various forms; for example, a spark plug, an internal combustion engine in which spark plugs are mounted, etc.

DETAILED DESCRIPTION OF THE PREFERRED EMBODIMENTS

A. First Embodiment

Figure 1:
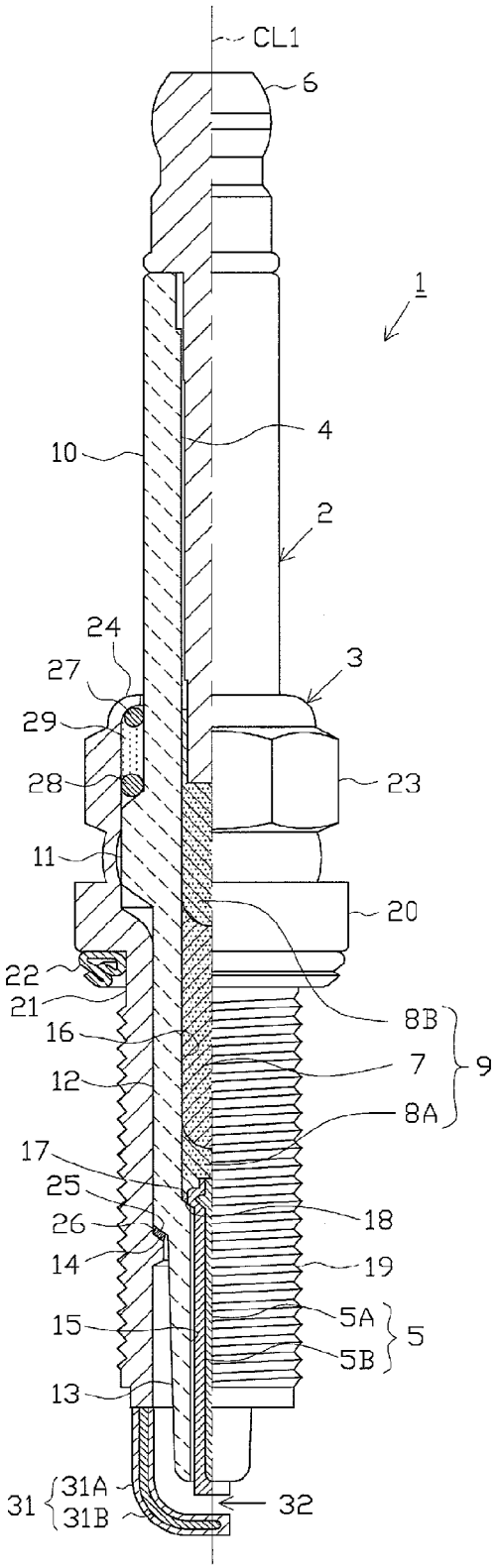
FIG. 1 is a partially cutaway front view showing the configuration of a spark plug.

An embodiment of the present invention will next be described with reference to the drawings. FIG. 1 is a partially cutaway front view showing a spark plug 1. In FIG. 1, the direction of an axial line CL1 of the spark plug 1 corresponds to the vertical direction of the drawing, and, in the following description, the lower side is referred to as the forward side of the spark plug 1, and the upper side is referred to as the rear side.

The spark plug 1 includes a ceramic insulator 2, which is a tubular insulator, and a metallic shell 3.

The ceramic insulator 2 is, as well known, formed from alumina or the like by firing and, as viewed externally, includes a rear trunk portion 10 formed at its rear side; a large-diameter portion 11 located forward of the rear trunk portion 10 and protruding radially outward; an intermediate trunk portion 12 located forward of the large-diameter portion 11 and being smaller in diameter than the large-diameter portion 11; and a leg portion 13 located forward of the intermediate trunk portion 12 and being smaller in diameter than the intermediate trunk portion 12. The large-diameter portion 11, the intermediate trunk portion 12, and most of the leg portion 13 of the ceramic insulator 2 are accommodated within the metallic shell 3. A tapered portion 14 tapering forward is formed at a connection portion between the intermediate trunk portion 12 and the leg portion 13, and the ceramic insulator 2 is seated on the metallic shell 3 at the tapered portion 14.

Furthermore, the ceramic insulator 2 has an axial hole 4 extending therethrough along the axial line CL1. The axial hole 4 has a small-diameter portion 15 formed at its forward end portion and has a large-diameter portion 16 located rearward of the small-diameter portion 15 and being larger in inside diameter than the small-diameter portion 15. Also, the axial hole 4 has a tapered, stepped portion 17 formed between the small-diameter portion 15 and the large-diameter portion 16.

Additionally, a center electrode 5 is fixedly inserted into the forward side (small-diameter portion 15) of the axial hole 4. More specifically, the center electrode 5 has an expanded portion 18 formed at its rear end portion and expanding radially outward, and the center electrode 5 is fixed in the axial hole 4 such that the expanded portion 18 rests on the stepped portion 17. The center electrode 5 includes an inner layer 5A formed of a metal having excellent thermal conductivity [e.g., copper, a copper alloy, or pure nickel (Ni)] and an outer layer 5B formed of an alloy which contains nickel as a main component. The center electrode 5 assumes a rodlike (circular columnar) shape as a whole, and its forward end portion protrudes from the forward end of the ceramic insulator 2.

Also, a terminal electrode 6 (also called a metal terminal member 6) is fixedly inserted into the rear side (large-diameter portion 16) of the axial hole 4 while protruding from the rear end of the ceramic insulator 2.

Furthermore, a circular columnar interelectrode insert 9 (also called a connection 9) is provided in the axial hole 4 between the center electrode 5 and the terminal electrode 6 and includes a resistor 7, and a forward seal 8A (also called a first seal 8A) and a rear seal 8B (also called a second seal 8B) between which the resistor 7 is held. The interelectrode insert 9 is electrically conductive, and the center electrode 5 and the terminal electrode 6 are electrically connected through the interelectrode insert 9. The interelectrode insert 9 is dotted portions of the resistor 7 and the two seals 8A and 8B, and is composed of the resistor 7, the forward seal 8A excluding a portion disposed around the outer circumference of the center electrode 5, and the rear seal 8B excluding a portion disposed around the outer circumference of the terminal electrode 6. That is, the interelectrode insert 9 is a portion located between the forward end of the terminal electrode 6 and the rear end of the center electrode 5.

The resistor 7 is adapted to restrain radio noise (noise) and has a resistance of, for example, 100Ω or more, which differs depending on specifications of the spark plug, though. The resistor 7 is formed in a sealed condition by heating a resistor composition composed of electrically conductive carbon [e.g., carbon black (more specifically, oil furnace black)], glass powder which contains silicon dioxide ($SiO_2$) and boron oxide ($B_2O_5$), ceramic particles [e.g., zirconium oxide ($ZrO_2$) particles, titanium oxide ($TiO_2$) particles, etc.], binder, etc., and thus contains carbon and glass.

Additionally, the forward seal 8A and the rear seal 8B are electrically conductive (e.g., the resistance is on the order of hundreds of milliohms); the forward seal 8A is provided between the resistor 7 and the center electrode 5; and the rear seal 8B is provided between the resistor 7 and the terminal electrode 6. The forward seal 8A fixes the center electrode 5 to the ceramic insulator 2, and the rear seal 8B fixes the terminal electrode 6 to the ceramic insulator 2.

The metallic shell 3 is formed into a tubular shape from a low-carbon steel or a like metal and has a threaded portion (externally threaded portion) 19 formed on its outer circumferential surface and adapted to mount the spark plug 1 into a mounting hole of a combustion apparatus (e.g., an internal combustion engine or a fuel cell reformer). Also, the metallic shell 3 has a collar-like seat portion 20 located rearward of the threaded portion 19, and a ring-like gasket 22 is fitted to a screw neck 21 located at the rear end of the threaded portion 19. Furthermore, the metallic shell 3 has, near the rear end thereof, a tool engagement portion 23 having a hexagonal cross section and allowing a tool, such as a wrench, to be engaged therewith when the metallic shell 3 is to be mounted to the combustion apparatus, and has a crimped portion 24 provided at a rear end portion thereof for holding the ceramic insulator 2. In the present embodiment, in order to implement the spark plug 1 having a small diameter (small size), the ceramic insulator 2 and the metallic shell 3 have a relatively small diameter; accordingly, the threaded portion 19 has a relatively small thread diameter (e.g., M12 or less).

Also, the metallic shell 3 has a tapered, stepped portion 25 provided on its inner circumferential surface and adapted to allow the ceramic insulator 2 to be seated thereon. The ceramic insulator 2 is inserted forward into the metallic shell 3 from the rear end of the metallic shell 3; and, in a state in which the tapered portion 14 of the ceramic insulator 2 butts against the stepped portion 25 of the metallic shell 3, a rear-end opening portion of the metallic shell 3 is crimped radially inward; i.e., the crimped portion 24 is formed, whereby the ceramic insulator 2 is fixed to the metallic shell 3. An annular sheet packing 26 intervenes between the tapered portion 14 and the stepped portion 25. This retains airtightness of a combustion chamber and prevents outward leakage of fuel gas entering a clearance between the leg portion 13 of the ceramic insulator 2 and the inner circumferential surface of the metallic shell 3, the clearance being exposed to the combustion chamber.

Furthermore, in order to ensure airtightness which is established by crimping, annular ring members 27 and 28 intervene between the metallic shell 3 and the ceramic insulator 2 in a region near the rear end of the metallic shell 3, and a space between the ring members 27 and 28 is filled with powder of talc 29. That is, the metallic shell 3 holds the ceramic insulator 2 through the sheet packing 26, the ring members 27 and 28, and the talc 29.

Also, a ground electrode 31 is joined to a forward end portion of the metallic shell 3 and is bent at its intermediate portion such that a side surface of its distal end portion faces a forward end portion of the center electrode 5. The ground electrode 31 includes an outer layer 31A formed of an alloy which contains nickel as a main component, and an inner layer 31B formed of a metal (e.g., copper, a copper alloy, or pure Ni) superior in thermal conductivity than the Ni alloy.

Furthermore, a gap 32 is formed between a forward end portion of the center electrode 5 and a distal end portion of the ground electrode 31, and spark discharges are performed across the gap 32 substantially along the axial line CL1.

Next, the structures of the resistor 7 and the interelectrode insert 9, which contains the resistor 7, will be described.

Figure 2:
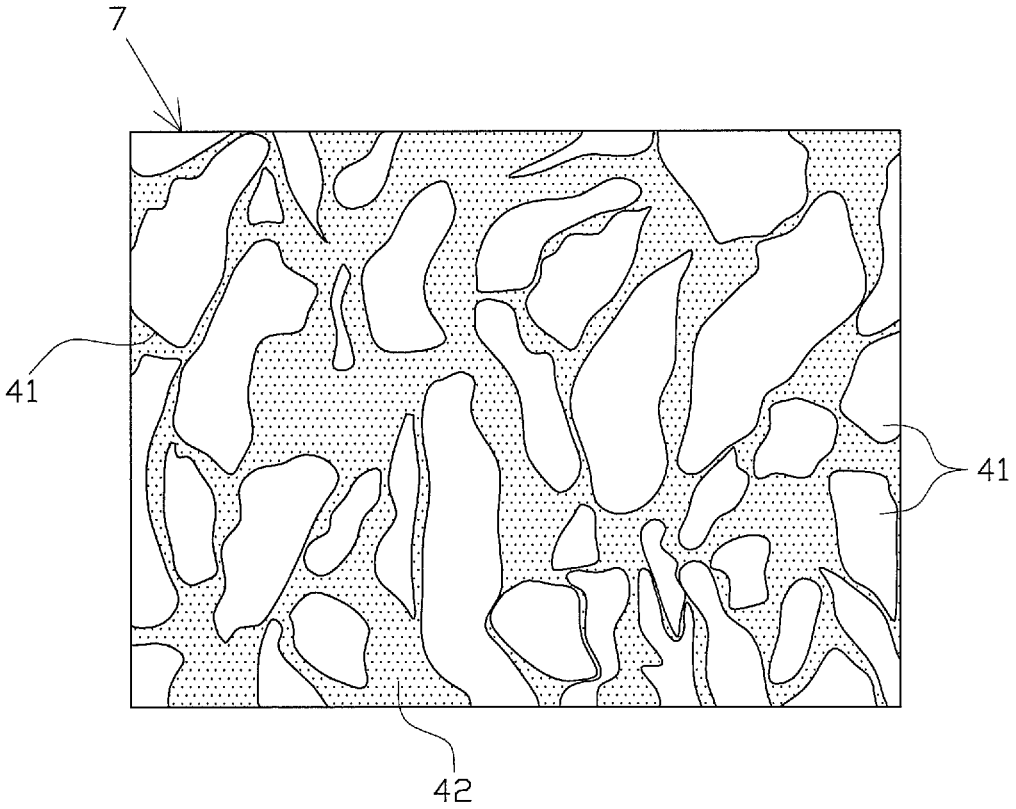
FIG. 2 is an enlarged sectional schematic view showing the structure of a resistor.

The resistor 7 is formed in a sealed condition by heating a resistor composition composed of carbon black, glass powder, ceramic particles, binder, etc., and thus contains carbon and glass. As shown in FIG. 2, the resistor 7 has a $SiO_2$-containing aggregate phase 41 and an interstitial phase 42 (in FIG. 2, dotted region), which exists in such a manner as to cover the aggregate phase 41.

The aggregate phase 41 is composed of glass particles from which a $B_2O_5$-rich glass component has melted out, and is higher in $SiO_2$ content than the interstitial phase 42. The interstitial phase 42 is composed primarily of the $B_2O_5$-rich glass component which has melted out from glass powder, and is higher in $B_2O_5$ content than the aggregate phase 41. Also, the interstitial phase 42 contains carbon and ceramic particles melted therein.

In a region between the center electrode 5 and the terminal electrode 6, electric current flows through the interstitial phase 42 which contains carbon; in this connection, as viewed in a section of the resistor 7, the interstitial phase 42 is finely reticulated as a result of existence of the aggregate phase 41. Also, in the interstitial phase 42, electrically conductive paths formed of carbon finely branch off as a result of existence of a glass component and ceramic particles. That is, electrically conductive paths in the resistor 7 quite finely branch off as a result of existence of the aggregate phase 41, ceramic particles, etc.

Figure 3:
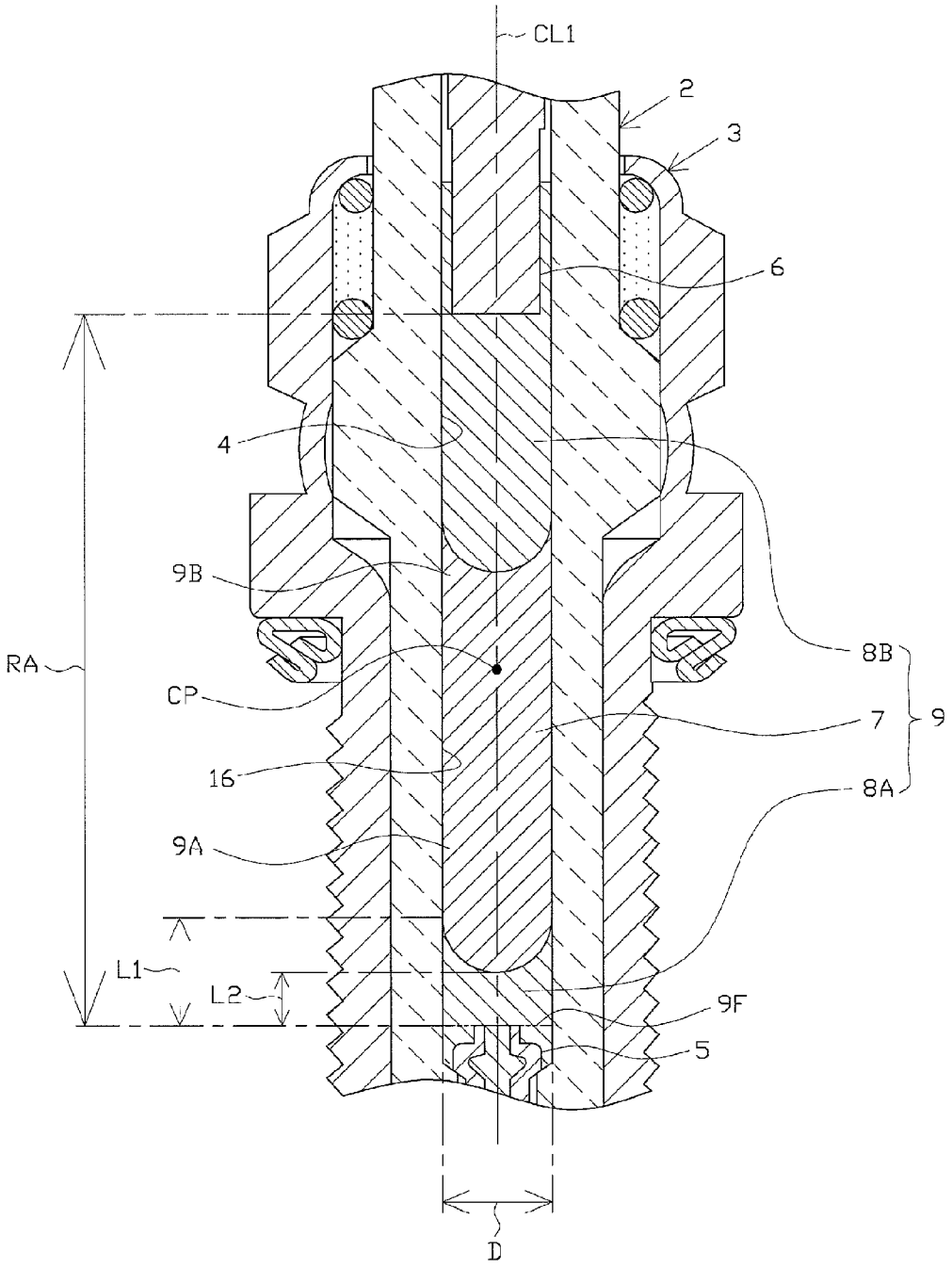
FIG. 3 is an enlarged sectional view showing an interelectrode insert, etc.

Additionally, in the present embodiment, as shown in FIG. 3, a forward portion 9A of the interelectrode insert 9 located forward of a center point CP along the axial line CL1 between the rear end of the center electrode 5 and the forward end of the terminal electrode 6 has a carbon content of 1.5% by mass to 4.0% by mass. Carbon includes carbon black and carbon originating from the binder contained in the resistor composition. The carbon content can be measured by cutting out the resistor, crushing the cutout resistor into pieces, and analyzing the pieces by use of a predetermined apparatus (e.g., EMIA-920V, product of HORIBA).

Furthermore, through adjustment of the carbon content of the resistor 7, the resistance between the rear end of the terminal electrode 6 and the rear end of the center electrode 5 (resistance of the interelectrode insert 9) is set to a value of 1.0 kΩ to 3.0 kΩ. That is, the interelectrode insert 9 has a relatively low resistance; thus, while ignition performance is excellent, at the time of application of voltage to the center electrode 5 for generating a spark discharge, a relatively large electric current flows through the resistor 7.

Notably, since the resistance of the center electrode 5 and the resistance of the terminal electrode 6 are very low (substantially zero), the resistance of the interelectrode insert 9 is substantially equal to the resistance between the rear end of the terminal electrode 6 and the forward end of the center electrode 5. Therefore, in obtaining the resistance of the interelectrode insert 9, the resistance between the rear end of the terminal electrode 6 and the forward end of the center electrode 5 may be measured, and the measured resistance can be said to be the resistance of the interelectrode insert 9.

Furthermore, the resistance of the forward portion 9A (resistance between the forward end and the rear end of the forward portion 9A) is lower than the resistance of a rear portion 9B of the interelectrode insert 9 located rearward of the center point CP (resistance between the forward end and the rear end of the rear portion 9B).

The resistances of the forward portion 9A and the rear portion 9B can be measured as follows. For example, by use of a micro CT scanner manufactured by TOSHIBA [product name: TOSCANER (registered trademark)], the forward end position of the terminal electrode 6 and the rear end position of the center electrode 5 are checked. Next, the spark plug 1 is cut along a direction orthogonal to the axial line CL1 at the center point CP between the forward end of the terminal electrode 6 and the rear end of the center electrode 5, and silver paste is applied to the sections of the interelectrode insert 9. As mentioned above, since the resistance of the center electrode 5 is very low (substantially zero), by measuring the resistance between the section of the interelectrode insert 9 and the forward end of the center electrode 5, the resistance of the forward portion 9A can be measured. Also, since the resistance of the terminal electrode 6 is very low, by measuring the resistance between the section of the interelectrode insert 9 and the rear end of the terminal electrode 6, the resistance of the rear portion 9B can be measured. Measurement of resistance is performed at a predetermined temperature of an object to be measured (in the present embodiment, 20° C.).

Additionally, the forward portion 9A is configured to have a resistance of 0.30 kΩ to 0.80 kΩ (more preferably, 0.35 kΩ to 0.65 kΩ) between the rear end and the forward end thereof.

Also, the forward portion 9A is configured to have 22% to 43% the resistance of the interelectrode insert 9. In the present embodiment, in forming the resistor 7, resistor compositions whose carbon contents are adjusted as appropriate are sequentially charged into the axial hole 4, thereby generating distribution of resistance along the axial line CL1.

Additionally, in the present embodiment, the resistor 7 is configured not to be located excessively close to the rear end of the center electrode 5 (gap 32). More specifically, a distance L1 along the axial line CL1 from the rear end of the forward seal 8A to the rear end of the center electrode 5 is set to 1.7 mm or more. Furthermore, a distance L2 along the axial line CL1 from a portion of the forward seal 8A in contact with the forward end of the resistor 7 (i.e., from the forward end of the resistor 7) to the rear end of the center electrode 5 is set to 0.2 mm or more.

Meanwhile, in the present embodiment, the resistor 7 is configured not to be located excessively away from the rear end of the center electrode 5. More specifically, the distance L1 is set to 3.7 mm or less, and the distance L2 is set to 1.5 mm or less.

Additionally, in the present embodiment, in association with a reduction in the diameter of the ceramic insulator 2, the resistor 7 has a relatively small diameter such that the axial hole 4 (large-diameter portion 16) has an inside diameter D of 3.5 mm or less or 2.9 mm or less at a forward end 9F of a range RA in which only the interelectrode insert 9 exists within the axial hole 4 in a section taken orthogonal to the axial line CL1.

Incidentally, the range RA can be identified from, for example, a see-through image obtained by use of the micro CT scanner.

As described above in detail, according to the present embodiment, the resistance of the interelectrode insert 9 is set to 3.0 kΩ, or less. Therefore, ignition performance can be improved.

Meanwhile, since the interelectrode insert 9 has a resistance of 3.0 kΩ, or less, at the time of application of voltage to the center electrode 5, a relatively large electric current flows through the interelectrode insert 9. Thus, particularly, at the forward portion 9A of the interelectrode insert 9 which has a high temperature, abrupt oxidation of electrically conductive paths formed of carbon is of concern.

In this connection, according to the present embodiment, the carbon content of the forward portion 9A is specified as 1.5% by mass or more. Therefore, electrically conductive paths formed in the forward portion 9A can be sufficiently thick, so that, at the time of application of electricity, heat generated in the electrically conductive paths can be reduced. As a result, oxidation of the electrically conductive paths can be effectively restrained.

Furthermore, according to the present embodiment, the carbon content is specified as 4.0% by mass or less and is thus reduced to such an extent as to be able to sufficiently restrain cohesion of carbon. Therefore, at the forward portion 9A, a sufficient number of electrically conductive paths can be formed. As a result, there can be reliably prevented a situation in which oxidation of a mere portion of electrically conductive paths leads to an abrupt increase in the resistance of the forward portion 9A (interelectrode insert 9).

Also, the forward portion 9A is specified as lower in resistance than the rear portion 9B. Therefore, at the time of application of electricity, heat generated at the forward portion 9A can be further reduced. As a result, oxidation of electrically conductive paths can be more effectively restrained.

As mentioned above, according to the present embodiment, at the forward portion 9A which is apt to have a high temperature and in which oxidation of electrically conductive paths is of greater concern, oxidation of the electrically conductive paths can be very effectively restrained; and, even when the electrically conductive paths are partially oxidized, an abrupt increase in resistance can be more reliably prevented. As a result, an excellent under-load life characteristic can be more reliably implemented for a spark plug which encounters difficulty in securing a good under-load life characteristic because of a resistance of the interelectrode insert 9 of 1.0 kΩ to 3.0 kΩ.

Also, since the resistance of the forward portion 9A is specified as 0.30 kΩ or more, at the time of spark discharge, there can be effectively restrained an abrupt flow, to the gap 32, of charge stored at an axial position in the spark plug 1 where the interelectrode insert 9 exists. As a result, capacitive discharge current can be sufficiently reduced, whereby a good noise restraining effect can be yielded.

Additionally, since the resistance of the forward portion 9A is specified as 0.80 kΩ or less, at the time of application of electricity, the generation of heat at the forward portion 9A can be further restrained. As a result, oxidization of electrically conductive paths can be more effectively restrained, whereby an excellent under-load life characteristic can be implemented.

Additionally, the resistance of the forward portion 9A is specified as 22% to 43% that of the interelectrode insert 9. Therefore, the effect of restraining the generation of heat of electrically conductive paths formed in the forward portion 9A and the effect of reducing capacitive discharge current can be improved in balance.

Also, since the distance L1 is specified as 1.7 mm or more, that outer circumferential portion of the resistor 7 through which electric current is particularly likely to flow can be located greatly away from the gap 32 (combustion chamber). Thus, at the time of combustion, an outer circumferential portion of the resistor 7 can be greatly reduced in the amount of received heat, whereby oxidation of electrically conductive paths in the outer circumferential portion of the resistor 7 can be more reliably restrained. As a result, an under-load life characteristic can be further improved.

Meanwhile, since the distance L1 is specified as 3.7 mm or less, a portion of the spark plug 1 located forward of the outer circumferential portion of the resistor 7 can be rendered short; eventually, charge stored at the portion can be sufficiently reduced. As a result, capacitive discharge current can be further reduced, whereby the noise restraining effect can be further enhanced.

Additionally, since the distance L1 is specified as 0.2 mm or more, the entire resistor 7 can be located sufficiently away from the gap 32 (combustion chamber). Thus, at the time of combustion, the resistor 7 can be further reduced in the amount of received heat, whereby oxidation of electrically conductive paths can be more reliably restrained. As a result, an under-load life characteristic can be further improved.

Meanwhile, since the distance L2 is specified as 1.5 mm or less, charge which is applied to the gap 32 without passage through the resistor 7 can be more reduced. As a result, capacitive discharge current can be further reduced, whereby the noise restraining effect can be further improved.

In the spark plug 1 of the present embodiment, since the inside diameter D of the axial hole 4 is specified as 3.5 mm or less or 2.9 mm or less, the density of the resistor 7 is apt to decrease; accordingly, difficulty is encountered in securing a good under-load life characteristic. However, by means of the forward portion 9A being rendered lower in resistance than the rear portion 9B while imparting a carbon content of 1.5% by mass to 4.0% by mass to the forward portion 9A, the spark plug 1 having such a small inside diameter D can exhibit a good under-load life characteristic. In other words, imparting a carbon content of 1.5% by mass to 4.0% by mass to the forward portion 9A, etc., are more effectively applied to a spark plug having an inside diameter D of 3.5 mm or less or 2.9 mm or less.

Next, in order to verify actions and effects to be yielded by the embodiment described above, there were manufactured spark plug samples which differed in the inside diameter D of the axial hole, the resistance between the forward end of the terminal electrode and the rear end of the center electrode (resistance of the interelectrode insert), the carbon content of the forward portion, the resistance of the forward portion, the ratio of the resistance of the forward portion to the resistance of the interelectrode insert (resistance ratio), and the distances L1 and L2; and the samples were subjected to an under-load life characteristic evaluation test and a restraint of radio noise evaluation test.

The under-load life characteristic evaluation test is outlined below. The samples were attached to an automotive transistor ignition apparatus and were caused to perform discharge 3,600 times per minute through application of a discharge voltage of 20 kV at a forward end temperature of the center electrode of 350° C.; and there was measured time (lifetime) when resistance at the room temperature became 1.5 times or more the initial resistance (resistance of interelectrode insert). Next, the samples were scored points at 10 stages according to lifetime. Scoring was as follows: sample 4 in Table 1 was scored one point, and the score was incremented by one point every time lifetime expanded by 10 hours from the lifetime of sample 4. With a score of five points or higher, the under-load life characteristic can be said to be good. The samples were configured such that the interelectrode inserts had a resistance of 1.0 kΩ to 3.0 kΩ so that a relatively large electric current flowed through the resistors.

The restraint of radio noise evaluation test is outlined below. The restraint of radio noise evaluation test was conducted in accordance with a test method for radio noise characteristics specified in the BOX method of JASO D002-2:2004, and the samples were tested for attenuation in a 150 MHz region. The attenuation of sample 14 in Table 1 was taken as a reference value, and in the case where the attenuation of a sample was equal to or greater than the reference value (i.e., noise at the time of test was equal to or less than a reference level), the sample was scored 10 points; and in the case where the attenuation of a sample was equal to or greater than a value obtained by subtracting 0.2 dB from the reference value, the sample was scored nine points. Subsequently, every time attenuation decreased by 0.2 dB, the score was decremented by one point. For example, in the case where attenuation was equal to or greater than a value obtained by subtracting 0.6 dB from the reference value and was less than a value obtained by subtracting 0.4 dB from the reference value, the score was seven points. With a score of seven points or higher, the radio noise restraining effect can be said to be good.

Table 1 shows the test results of samples having a resistance of the interelectrode insert of 1.7 kΩ. Also, Table 2 shows the test results of samples having a resistance of the interelectrode insert of 1.0 kΩ, and Table 3 shows the test results of samples having a resistance of the interelectrode insert of 3.0 kΩ. In the under-load life characteristic evaluation test, individual samples were prepared in a quantity of two, and the two samples had substantially the same parameter values such as substantially the same inside diameter D and substantially the same resistance of the interelectrode insert; and one sample was measured for the resistance of the interelectrode insert, etc., and the other sample was actually tested. Also, the samples having a resistance of the interelectrode insert of 1.0 kΩ (samples in Table 2) and the samples having a resistance of the interelectrode insert of 3.0 kΩ (samples in Table 3) had a distance L1 of 2.7 mm and a distance L2 of 0.8 mm.

TABLE 1

| No. | Inside dia. D (mm) | Resistance of interelectrode insert (kΩ) | Carbon content of forward portion (% by mass) | Resistance of forward portion (kΩ) | Resistance ratio (%) | L1 (mm) | L2 (mm) | Under-load life evaluation | Restraint of radio noise evaluation |
|---|---|---|---|---|---|---|---|---|---|
| 1 | 4.0 | 1.7 | 1.0 | 0.80 | 47 | 2.7 | 0.8 | 4 | 10 |
| 2 | 3.5 | 1.7 | 1.0 | 0.80 | 47 | 2.7 | 0.8 | 3 | 10 |
| 3 | 3.1 | 1.7 | 1.0 | 0.80 | 47 | 2.7 | 0.8 | 2 | 10 |
| 4 | 2.9 | 1.7 | 1.0 | 0.80 | 47 | 2.7 | 0.8 | 1 | 10 |
| 5 | 3.5 | 1.7 | 7.0 | 0.30 | 18 | 2.7 | 0.8 | 3 | 7 |

TABLE 1-continued

| No. | Inside dia. D (mm) | Resistance of interelectrode insert (kΩ) | Carbon content of forward portion (% by mass) | Resistance of forward portion (kΩ) | Resistance ratio (%) | L1 (mm) | L2 (mm) | Under-load life evaluation | Restraint of radio noise evaluation |
|---|---|---|---|---|---|---|---|---|---|
| 6 | 4.0 | 1.7 | 1.5 | 1.00 | 59 | 2.7 | 0.8 | 4 | 10 |
| 7 | 3.5 | 1.7 | 1.5 | 1.00 | 59 | 2.7 | 0.8 | 3 | 10 |
| 8 | 4.0 | 1.7 | 4.0 | 0.10 | 6 | 2.7 | 0.8 | 10 | 6 |
| 9 | 3.5 | 1.7 | 4.0 | 0.10 | 6 | 2.7 | 0.8 | 10 | 6 |
| 10 | 4.0 | 1.7 | 3.5 | 0.30 | 18 | 2.7 | 0.8 | 9 | 7 |
| 11 | 3.5 | 1.7 | 4.0 | 0.30 | 18 | 2.7 | 0.8 | 9 | 7 |
| 12 | 3.5 | 1.7 | 3.5 | 0.30 | 18 | 2.7 | 0.8 | 9 | 7 |
| 13 | 4.0 | 1.7 | 1.5 | 0.70 | 41 | 2.7 | 0.8 | 9 | 10 |
| 14 | 3.5 | 1.7 | 3.5 | 0.70 | 41 | 2.7 | 0.8 | 8 | 10 |
| 15 | 3.5 | 1.7 | 1.5 | 0.70 | 41 | 2.7 | 0.8 | 8 | 10 |
| 16 | 3.1 | 1.7 | 3.0 | 0.73 | 43 | 2.7 | 0.8 | 8 | 10 |
| 17 | 3.5 | 1.7 | 3.0 | 0.80 | 47 | 2.7 | 0.8 | 7 | 10 |
| 18 | 3.1 | 1.7 | 3.0 | 0.80 | 47 | 2.7 | 0.8 | 6 | 10 |
| 19 | 2.9 | 1.7 | 3.0 | 0.80 | 47 | 2.7 | 0.8 | 6 | 10 |
| 20 | 3.5 | 1.7 | 4.0 | 0.35 | 21 | 2.7 | 0.8 | 10 | 10 |
| 21 | 3.5 | 1.7 | 4.0 | 0.38 | 22 | 2.7 | 0.8 | 10 | 10 |
| 22 | 3.5 | 1.7 | 3.0 | 0.45 | 26 | 2.7 | 0.8 | 10 | 10 |
| 23 | 3.1 | 1.7 | 3.0 | 0.45 | 26 | 2.7 | 0.8 | 10 | 10 |
| 24 | 2.9 | 1.7 | 3.0 | 0.45 | 26 | 2.7 | 0.8 | 10 | 10 |
| 25 | 3.5 | 1.7 | 3.5 | 0.65 | 38 | 2.7 | 0.8 | 10 | 10 |
| 26 | 3.5 | 1.7 | 4.0 | 0.35 | 21 | 1.3 | 0.8 | 8 | 10 |
| 27 | 3.5 | 1.7 | 4.0 | 0.35 | 21 | 1.7 | 0.8 | 10 | 10 |
| 28 | 3.5 | 1.7 | 4.0 | 0.35 | 21 | 3.7 | 0.8 | 10 | 10 |
| 29 | 3.5 | 1.7 | 4.0 | 0.35 | 21 | 4.2 | 0.8 | 10 | 8 |
| 30 | 3.5 | 1.7 | 4.0 | 0.35 | 21 | 2.7 | 0.0 | 8 | 10 |
| 31 | 3.5 | 1.7 | 4.0 | 0.35 | 21 | 2.7 | 0.2 | 10 | 10 |
| 32 | 3.5 | 1.7 | 4.0 | 0.35 | 21 | 2.7 | 1.5 | 10 | 10 |
| 33 | 3.5 | 1.7 | 4.0 | 0.35 | 21 | 2.7 | 2.0 | 10 | 8 |

TABLE 2

| No. | Inside dia. D (mm) | Resistance of interelectrode insert (kΩ) | Carbon content of forward portion (% by mass) | Resistance of forward portion (kΩ) | Resistance ratio (%) | Under-load life evaluation | Restraint of radio noise evaluation |
|---|---|---|---|---|---|---|---|
| 41 | 3.5 | 1.0 | 1.0 | 1.00 | 100 | 1 | 10 |
| 42 | 3.5 | 1.0 | 7.0 | 0.30 | 30 | 1 | 8 |
| 43 | 3.5 | 1.0 | 3.5 | 0.65 | 65 | 1 | 10 |
| 44 | 3.5 | 1.0 | 1.5 | 0.80 | 80 | 1 | 10 |
| 45 | 3.5 | 1.0 | 3.5 | 0.80 | 80 | 1 | 10 |
| 46 | 3.5 | 1.0 | 1.5 | 1.00 | 100 | 1 | 10 |
| 47 | 3.5 | 1.0 | 3.0 | 1.00 | 100 | 1 | 10 |
| 48 | 3.5 | 1.0 | 4.0 | 0.10 | 10 | 10 | 6 |
| 49 | 3.5 | 1.0 | 4.0 | 0.30 | 30 | 10 | 8 |
| 50 | 3.5 | 1.0 | 3.5 | 0.30 | 30 | 10 | 8 |
| 51 | 3.5 | 1.0 | 4.0 | 0.35 | 35 | 10 | 10 |

TABLE 3

| No. | Inside dia. D (mm) | Resistance of interelectrode insert (kΩ) | Carbon content of forward portion (% by mass) | Resistance of forward portion (kΩ) | Resistance ratio (%) | Under-load life evaluation | Restraint of radio noise evaluation |
|---|---|---|---|---|---|---|---|
| 61 | 3.5 | 3.0 | 1.0 | 1.00 | 33 | 1 | 10 |
| 62 | 3.5 | 3.0 | 7.0 | 0.30 | 10 | 1 | 8 |
| 63 | 3.5 | 3.0 | 3.0 | 1.60 | 53 | 1 | 10 |
| 64 | 3.5 | 3.0 | 4.0 | 0.10 | 3 | 10 | 1 |
| 65 | 3.5 | 3.0 | 4.0 | 0.30 | 10 | 10 | 8 |
| 66 | 3.5 | 3.0 | 3.5 | 0.30 | 10 | 10 | 8 |
| 67 | 3.5 | 3.0 | 3.5 | 0.80 | 27 | 8 | 10 |
| 68 | 3.5 | 3.0 | 2.0 | 0.80 | 27 | 8 | 10 |
| 69 | 3.5 | 3.0 | 2.0 | 1.00 | 33 | 6 | 10 |
| 70 | 3.5 | 3.0 | 4.0 | 0.35 | 12 | 10 | 9 |
| 71 | 3.5 | 3.0 | 3.5 | 0.65 | 22 | 10 | 10 |

As shown in Tables 1 to 3, the samples having a carbon content of the forward portion of less than 1.5% by mass (samples 1 to 4, 41, and 61) are scored less than five points in the under-load life characteristic evaluation test, indicating that an under-load life characteristic is insufficient. Conceivably, this is for the reason that at least one of (1) and (2) below occurred.

(1) At the forward portion which particularly has a high temperature and in which electrically conductive paths formed in the resistor are apt to be oxidized, a sufficient number of electrically conductive paths failed to be formed, and resistance abruptly increased as a result of partial oxidation of the electrically conductive paths.

(2) At the forward portion, a sufficient number of electrically conductive paths were formed; however, since individual electrically conductive paths became thin, heat generated at the time of conduction of electricity through the electrically conductive paths increased, resulting in abrupt oxidization of the electrically conductive paths.

Also, the samples having a carbon content of the forward portion in excess of 4.0% by mass (samples 5, 42, and 62) exhibited an insufficient under-load life characteristic. Conceivably, this is for the following reason: as a result of an excessive increase in carbon content, carbon significantly cohered, resulting in a failure to form a sufficient number of electrically conductive paths.

Furthermore, as is apparent from the test results of samples 1 to 4 in Table 1, the smaller the inside diameter D, the more likely the deterioration of an under-load life characteristic. Conceivably, this is for the following reason: the smaller the inside diameter D, the more unlikely pressure is to be applied to a forward portion of a resistor composition in compressing the resistor composition charged into the axial hole.

Additionally, the samples (samples 6, 7, 43 to 47, and 63) having a resistance ratio of 50% or higher (i.e., the forward portion is higher in resistance than the rear portion) exhibited an insufficient under-load life characteristic. Conceivably, this is for the following reason: at the time of application of electricity, the amount of heat generated in the forward portion increased; as a result, electrically conductive paths became likely to be oxidized.

By contrast, the samples having a carbon content of the forward portion of 1.5% by mass to 4.0% by mass and a resistance ratio of less than 50% (samples 8 to 33, 48 to 51, and 65 to 71) are scored five points or higher in the under-load life characteristic evaluation test, indicating that the samples have a good under-load life characteristic. Conceivably, this is for synergy of (3) to (5) below.

(3) Through employment of a carbon content of the forward portion of 1.5% by mass or more, electrically conductive paths became sufficiently thick; thus, heat generated at the time of application of electricity reduced, whereby the electrically conductive paths became unlikely to be oxidized.

(4) Through employment of a carbon content of the forward portion of 4.0% by mass or less, a sufficient number of electrically conductive paths were formed, there did not arise the situation in which oxidation of a mere portion of electrically conductive paths led to an abrupt increase in resistance.

(5) Through employment of a resistance ratio of less than 50% (the forward portion was rendered lower in resistance than the rear portion), heat generated in the forward portion at the time of application of electricity further reduced, whereby the effect of restraining oxidation of electrically conductive paths was further enhanced.

Furthermore, the samples having a resistance of the forward portion of 0.30 kΩ to 0.80 kΩ (samples 10 to 33, 49 to 51, and 65 to 71) are scored six points or higher in the under-load life characteristic evaluation test and seven points or higher in the restraint of radio noise evaluation test, indicating that the samples have a good under-load life characteristic and an excellent noise restraining effect. Conceivably, this is for reasons of (6) and (7) below.

(6) Through employment of a resistance of the forward portion of 0.30 kΩ or less, at the time of spark discharge, there was effectively restrained an abrupt flow, to the gap, of charge stored at a position in the spark plug where the interelectrode insert existed; as a result, capacitive discharge current was sufficiently reduced, whereby the noise restraining effect was improved.

(7) Through employment of a resistance of the forward portion of 0.80 kΩ or less, at the time of application of electricity, the generation of heat of electrically conductive paths formed in the forward portion was further restrained, whereby oxidation of the electrically conductive paths was more effectively restrained.

Particularly, the samples having a resistance of the forward portion of 0.45 kΩ to 0.65 kΩ (samples 20 to 33, 51, 70, and 71) are scored eight points or higher in the under-load life characteristic evaluation test and in the restraint of radio noise evaluation test, indicating that the samples are excellent in both under-load life characteristic and noise restraining effect.

Furthermore, as a result of comparison among the samples having the same parameter values such as the same resistance of the interelectrode insert (samples 16, 18, 23, 70, and 71), the samples having a resistance ratio (the ratio of resistance of the forward portion to resistance of the interelectrode insert) of 22% to 43% (samples 16, 23, and 71) were found to be more improved in under-load life characteristic and noise restraining effect. Conceivably, this is for the following reason: through employment of a resistance ratio of 22% to 43%, at the time of application of electricity, the effect of restraining the generation of heat in the forward portion and the effect of reducing capacitive discharge current were yielded in balance.

Additionally, in comparison of the samples which differ only in distances L1 and L2 (samples 26 to 33), the samples having a distance L1 of 1.7 mm or more and a distance L2 of 0.2 mm or more (samples 27 to 29 and 31 to 33) exhibit a very good under-load life characteristic. Conceivably, this is for reasons of (8) and (9) below.

(8) Through employment of a distance L1 of 1.7 mm or more, that outer circumferential portion of the resistor through which electric current is particularly likely to flow was located greatly away from the gap (combustion chamber), whereby oxidation of electrically conductive paths in the outer circumferential portion of the resistor was quite effectively restrained.

(9) Through employment of a distance L2 of 0.2 mm or more, the entire resistor was located sufficiently away from the gap (combustion chamber), whereby, at the time of combustion, the amount of heat received by the resistor was reduced.

Furthermore, the samples having a distance L1 of 3.7 mm or less and a distance L2 of 1.5 mm or less (samples 26 to 28 and 30 to 32) were found to be quite excellent in noise restraining effect. Conceivably, this is for reasons of (10) and (11) below.

(10) A portion of the spark plug located forward of the outer circumferential portion of the resistor was rendered short through employment of a distance L1 of 3.7 mm or less, whereby charge stored at the portion of the spark plug was sufficiently reduced.

(11) Through employment of a distance L2 of 1.5 mm or less, charge which was applied to the gap without passage through the resistor was reduced, whereby capacitive discharge current was more reduced.

From the results of the above-mentioned tests, it can be said to be preferred that, in a spark plug in which the resistor of the interelectrode insert has a resistance of 1.0 kΩ to 3.0 kΩ, and thus a relatively large current flows through the resistor, in view of securing of a good under-load life characteristic, the carbon content of the forward portion be 1.5% by mass to 4.0% by mass, and the forward portion be lower in resistance than the rear portion.

Also, in view of further improvement of an under-load life characteristic and implementation of an excellent noise restraining effect, preferably, the resistance of the forward portion is 0.30 kΩ to 0.80 kΩ, more preferably, 0.45 kΩ to 0.65 kΩ.

Furthermore, more preferably, in order to achieve a further improvement of an under-load life characteristic and a noise restraining effect, the resistance of the forward portion is 22% to 43% the resistance of the interelectrode insert.

Additionally, preferably, in order to achieve a further improvement of an under-load life characteristic, the distance L1 is 1.7 mm or more, and the distance L2 is 0.2 mm or more.

Also, preferably, in view of a further improvement of a noise restraining effect, the distance L1 is 3.7 mm or less, and the distance L2 is 1.5 mm or less.

Even in the case of a spark plug in which the inside diameter D is small and which encounters difficulty in securing a good under-load life characteristic, through employment of a carbon content of the forward portion of 1.5% by mass to 4.0% by mass, etc., a good under-load life characteristic can be implemented. In other words, the above-mentioned configurational features which contribute to improvement of an under-load life characteristic, such as a carbon content of the forward portion of 1.5% by mass to 4.0% by mass, are effective in application to a spark plug having an inside diameter D of 3.5 mm or less and are very effective in application to a spark plug having an inside diameter D of 2.9 mm or less.

The present invention is not limited to the above embodiment, but may be embodied, for example, as follows. Needless to say, other applications and modifications not exemplified below are also possible.

(a) In the above embodiment, the inside diameter D is 3.5 mm or less or 2.9 mm or less; however, the technical ideas of the present disclosure may be applied to a spark plug having an inside diameter D in excess of 3.5 mm.

(b) The above embodiment shows $ZrO_2$ particles and $TiO_2$ particles as ceramic particles; however, other ceramic particles may be used. Therefore, for example, aluminum oxide ($Al_2O_3$) particles, etc., may be used.

(c) In the above embodiment, the ground electrode 31 is joined to a forward end portion of the metallic shell 3; however, the present invention can also be applied to the case where a portion of a metallic shell (or, a portion of an end metal piece welded beforehand to the metallic shell) is formed into a ground electrode by machining (refer to, for example, Japanese Patent Application Laid-Open (kokai) No. 2006-236906).

(d) In the above embodiment, the tool engagement portion 23 has a hexagonal cross section; however, the shape of the tool engagement portion 23 is not limited thereto. For example, the tool engagement portion may have a Bi-HEX (modified dodecagonal) shape [ISO22977:2005(E)] or the like.

B. Second Embodiment

Figure 4:
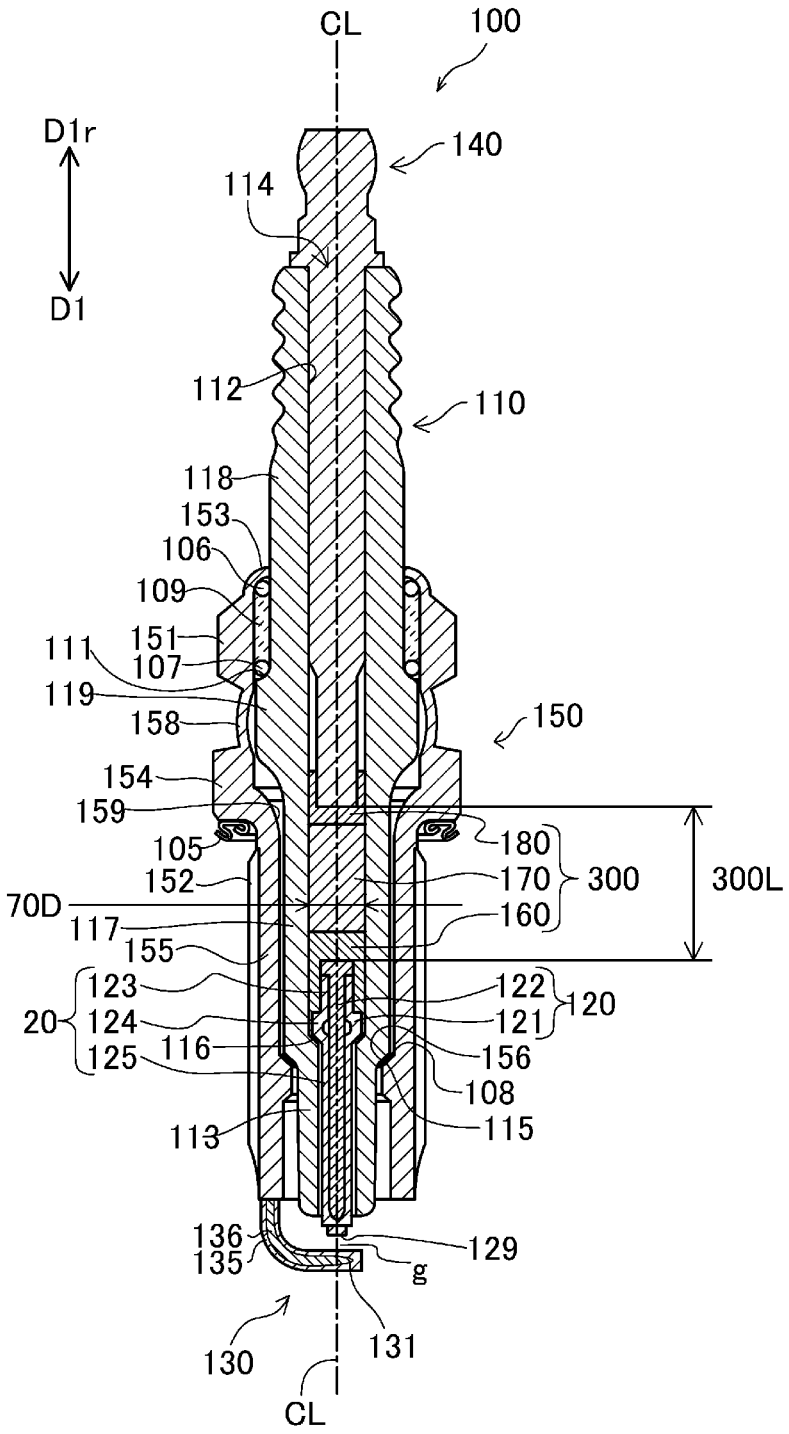
FIG. 4 is a sectional view showing an example of a spark plug.

FIG. 4 is a sectional view of an example spark plug according to a second embodiment of the present invention. The illustrated line CL indicates the center axis of a spark plug 100. The illustrated section is a section which contains the center axis CL. Hereinafter, the center axis CL may also be called the "axial line CL," and a direction in parallel with the center axis CL may also be called the "axial direction." A radial direction of a circle centered on the center axis CL may also be called the "radial direction," and a circumferential direction of a circle centered on the center axis CL may also be called the "circumferential direction." Regarding a direction in parallel with the center axis CL, a downward direction in FIG. 4 may also be called the "forward direction D1," and an upward direction may also be called the "rearward direction D1*r*." The forward direction D1 is directed toward electrodes 120 and 130 from a metal terminal member 140, which will be described later. Also, a side in the forward direction D1 in FIG. 4 is called the forward side of the spark plug 100, and a side in the rearward direction D1*r* in FIG. 4 is called the rear side of the spark plug 100.

The spark plug 100 includes an insulator 110 (hereinafter, may also be called the "ceramic insulator 110"), a center electrode 120, a ground electrode 130, the metal terminal member 140 (may also be called the terminal electrode 140), a metallic shell 150, an electrically conductive first seal 160, a resistor 170, an electrically conductive second seal 180, a forward packing 108, a talc 109, a first rear packing 106, and a second rear packing 107.

The insulator 110 is a substantially cylindrical member having a through hole 112 (hereinafter, may also be called the "axial hole 112") extending therethrough along the center axis CL. The insulator 110 is formed from alumina by firing (a different electrically insulating material may be employed). The insulator 110 has, sequentially in the rearward direction D1*r*, a leg portion 113, a first outside diameter reducing portion 115, a forward trunk portion 117, a collar portion 119, a second outside diameter reducing portion 111, and a rear trunk portion 118. The outside diameter of the first outside diameter reducing portion 115 gradually reduces forward. The insulator 110 has an inside diameter reducing portion 116 formed in the vicinity of the first outside diameter reducing portion 115 (in the example of FIG. 4, in the forward trunk portion 117), and the inside diameter of the inside diameter reducing portion 116 gradually reduces forward. The outside diameter of the second outside diameter reducing portion 111 gradually reduces rearward.

The rodlike center electrode 120 extending along the center axis CL is inserted into a forward portion of the axial hole 112 of the insulator 110. The center electrode 120 has, sequentially in the rearward direction D1*r*, a leg portion 125, a collar portion 124, and a head portion 123. A forward end portion of the leg portion 125 protrudes from the forward end of the axial hole 112 of the insulator 110. The collar portion 124 is supported at its surface on the forward direction D1 side by the inside diameter reducing portion 116 of the insulator 110. Also, the center electrode 120 has an outer layer 121 and a core 122. A rear end portion of the core 122 is exposed from the outer layer 121 and forms a rear end portion of the center electrode 120. The other portion of the core 122 is covered with the outer layer 121. However, the entire core 122 may be covered with the outer layer 121.

The outer layer 121 is formed of a material which is superior in oxidation resistance to the core 122; i.e., a material which is less eroded upon exposure to combustion gas in a combustion chamber of an internal combustion engine. The outer layer 121 is formed of, for example, nickel (Ni) or an alloy which contains nickel as a main component (e.g., "INCONEL," a registered trademark). The "main component" means a component whose content is the highest (the same also applies to the following description). The content is expressed in percent by mass (wt. %). The core 122 is formed of a material which is higher in thermal conductivity than the outer layer 121; for example, a material which contains copper (e.g., pure copper or an alloy which contains copper as a main component).

A portion of the metal terminal member 140 is inserted into a rear portion of the axial hole 112 of the insulator 110. The metal terminal member 140 is formed of an electrically conductive material (e.g., low-carbon steel or a like metal). The resistor 170 having a circular columnar shape is disposed in the axial hole 112 of the insulator 110 between the metal terminal member 140 and the center electrode 120 in order to restrain electrical noise. The resistor 170 is formed of a material which contains an electrically conductive material (e.g., carbon particles), type 1 particles having a relatively large particle size (e.g., glass particles such as $SiO_2$—$B_2O_3$—$Li_2O$—BaO glass particles), and type 2 particles having a relatively small particle size (e.g., $ZrO_2$ particles and $TiO_2$ particles). The illustrated resistor diameter 70D is the outside diameter of the resistor 170. In the present embodiment, the resistor diameter 70D is equal to the inside diameter of that portion of the through hole 112 of the insulator 110 which accommodates the resistor 170 therein.

In the through hole 112 of the insulator 110, the electrically conductive first seal 160 (also called the forward seal 160) is disposed between the resistor 170 and the center electrode 120, and the electrically conductive second seal 180 (also called the rear seal 180) is disposed between the resistor 170 and the metal terminal member 140. The seals 160 and 180 are formed of a material which contains glass particles and metal particles (e.g., Cu particles) similar to those contained in a material for the resistor 170.

The center electrode 120 and the metal terminal member 140 are electrically connected through the resistor 170 and the seals 160 and 180. Hereinafter, the members (herein, the plurality of members 160, 170, and 180) which electrically connect the center electrode 120 and the metal terminal member 140 in the through hole 112 are collectively called a connection 300 or an interelectrode insert 300. The illustrated connection length 300L is a distance along the center axis CL between the rear end (end on the rearward direction D1*r* side) of the center electrode 120 and the forward end (end on the forward direction D1 side) of the metal terminal member 140.

The metallic shell 150 is a substantially cylindrical member having a through hole 159 extending therethrough along the center axis CL (in the present embodiment, the center axis of the metallic shell 150 coincides with the center axis CL of the spark plug 100). The metallic shell 150 is formed of low-carbon steel (another electrically conductive material (e.g., a metal material) may be employed). The insulator 110 is inserted into the through hole 159 of the metallic shell 150. The metallic shell 150 is fixed to the outer circumference of the insulator 110. A forward end portion of the insulator 110 (in the present embodiment, a forward end portion of the leg portion 113) protrudes outward from the forward end of the through hole 159 of the metallic shell 150. A rear portion of the insulator 110 (in the present embodiment, a rear portion of the rear trunk portion 118) protrudes outward from the rear end of the through hole 159 of the metallic shell 150.

The metallic shell 150 has, sequentially from the forward side to the rear side, a trunk portion 155, a seat portion 154, a deformed portion 158, a tool engagement portion 151, and a crimped portion 153. The seat portion 154 is a collar portion. The trunk portion 155 has a threaded portion 152 formed on its outer circumferential surface for threading engagement with a mounting hole of an internal combustion engine (e.g., gasoline engine). An annular gasket 105 formed by folding a metal plate is fitted between the seat portion 154 and the threaded portion 152.

The metallic shell 150 has an inside diameter reducing portion 156 disposed on the forward direction D1 side with respect to the deformed portion 158. The inside diameter of the inside diameter reducing portion 156 gradually reduces forward. The forward packing 108 is nipped between the inside diameter reducing portion 156 of the metallic shell 150 and the first outside diameter reducing portion 115 of the insulator 110. The forward pack 108 is an O-ring made of iron (another material (e.g., a metal material such as copper) may be employed).

The tool engagement portion 151 has a shape (e.g., hexagonal prism) corresponding to a spark plug wrench to be engaged therewith. The crimped portion 153 is provided rearward of the tool engagement portion 151. The crimped portion 153 is disposed rearward of the second outside diameter reducing portion 111 of the insulator 110 and forms the rear end (i.e., end on the rearward direction D1*r* side) of the metallic shell 150. The crimped portion 153 is bent radially inward. On the forward direction D1 side of the crimped portion 153, the first rear packing 106, talc 109, and the second rear packing 107 are disposed sequentially in the forward direction D1 between the inner circumferential surface of the metallic shell 150 and the outer circumferential surface of the insulator 110. In the present embodiment, the rear packings 106 and 107 are C-rings made of iron (another material may be employed).

In manufacture of the spark plug 100, a predecessor of the crimped portion 153 is bent inward for crimping. Accordingly, the crimped portion 153 is pressed in the forward direction D1. Thus, a predecessor of the deformed portion 158 is deformed, whereby the insulator 110 is pressed forward within the metallic shell 150 through the packings 106 and 107 and the talc 109. The forward packing 108 is pressed between the first outside diameter reducing portion 115 and the inside diameter reducing portion 156, thereby providing a seal between the metallic shell 150 and the insulator 110. By the above procedure, the metallic shell 150 is fixed to the insulator 110.

The ground electrode 130 is joined to the forward end (i.e., end on the forward direction D1 side) of the metallic shell 150. In the present embodiment, the ground electrode 130 is a rodlike electrode. The ground electrode 130 extends in the forward direction D1 from the metallic shell 150, is bent toward the center axis CL, and reaches a distal end portion 131. The distal end portion 131 defines a gap g in cooperation with a forward end surface 129 (surface 129 on the forward direction D1 side) of the center electrode 120. The ground electrode 130 is joined (e.g., laser-welded) to the metallic shell 150 in an electrically conductive manner. The ground electrode 130 has a base metal 135 which forms the surface of the ground electrode 130, and a core 136 embedded in the base metal 135. The base metal 135 is, for example, INCONEL. The core 136 is formed of a material (e.g., pure copper) higher in thermal conductivity than the base metal 135.

In manufacture of such the spark plug 100, any manufacturing method can be employed. For example, the following manufacturing method can be employed. First, the insulator 110, the center electrode 120, the metal terminal member 140, the metallic shell 150, and the rodlike ground electrode 130 are manufactured by conventionally known methods. Material powder for the seals 160 and 180 and material powder for the resistor 170 are prepared.

In preparation of a powder material for the resistor 170, first, an electrically conductive material, type 2 particles (e.g., $ZrO_2$ particles and $TiO_2$ particles) larger in particle size than the electrically conductive material, and binder are mixed. For example, carbon particles such as carbon black can be employed as the electrically conductive material. For example, a dispersant such as polycarboxylic acid can be employed as binder. Water as solvent is added to these materials, followed by mixing by use of a wet ball mill. By use of the resultant mixture, particles are formed by a spray dry method. Next, the mixture particles, type 1 particles (e.g., glass particles) larger in particle size than type 2 particles, and water are mixed. Then, the resultant mixture is dried, thereby yielding the powder material for the resistor 170. In this manner, since type 2 particles to which an electrically conductive material adheres are mixed with type 1 particles, the electrically conductive material can be dispersed in contrast to the case where the electrically conductive material is directly mixed with type 1 particles.

Next, the center electrode 120 is inserted from an opening (hereinafter, called the "rear opening 114"), on the rearward direction D1*r* side, of the through hole 112 of the insulator 110. As described with reference to FIG. 4, the center electrode 120 is supported by the inside diameter reducing portion 116 of the insulator 110, thereby being disposed at a predetermined position within the through hole 112.

Next, material powders for the first seal 160, the resistor 170, and the second seal 180 are charged and formed into the members 160, 170, and 180 in this order. The material powders are charged from the rear opening 114 of the through hole 112. Forming of the charged powder is performed by use of a rod inserted from the rear opening 114. The material powders are formed into substantially the same shapes as those of the corresponding members.

Next, the insulator 110 is heated to a predetermined temperature higher than the softening point of a glass component contained in the material powders; then, while the insulator 110 is heated at the predetermined temperature, the metal terminal member 140 is inserted into the through hole 112 from the rear opening 114 of the through hole 112. As a result, the material powders are compressed and sintered, whereby the seals 160 and 180 and the resistor 170 are formed.

Next, the metallic shell 150 is assembled to the outer circumference of the insulator 110, and the ground electrode 130 is joined to the metallic shell 150. Then, the ground electrode 130 is bent, thereby completing the spark plug.

C. First Evaluation Test for Second Embodiment

C-1. Outline of First Evaluation Test

The first evaluation test evaluated restraint of radio noise and under-load life by use of samples of the spark plug 100 of the embodiment. The following Table 4 shows relations among sample type No., the number NL1 of type 1 lines, the component ratio R (Ti/Zr), the number NL2 of type 2 lines, the average NcpA for the maximum longitudinal continuation number Ncp, the connection length 300L (unit: mm), the resistor diameter 70D (unit: mm), evaluation of restraint of radio noise (hereinafter, called "radio noise evaluation"), and under-load life evaluation. In this evaluation test, 23 types of samples K1 through K23 were evaluated.

TABLE 4

| No. | Number of type 1 lines NL1 (Nc ≥ 2) | Component ratio R (Ti/Zr) | Number of type 2 lines NL2 (Ncc ≥ 2) | Average NcpA for maximum longitudinal continuation number Ncp | Connection length 300 L | Resistor diameter 70 D | Radio noise evaluation | Under-load life evaluation |
|---|---|---|---|---|---|---|---|---|
| K1 | 1 | 1 | 0 | 3.0 | 11 | 3.5 | 2 | 2 |
| K2 | 5 | 1 | 3 | 1.9 | 11 | 3.5 | 4 | 6 |
| K3 | 5 | 1 | 5 | 1.8 | 11 | 3.5 | 4 | 9 |
| K4 | 7 | 1 | 3 | 2.1 | 11 | 3.5 | 4 | 6 |
| K5 | 7 | 1 | 5 | 2.0 | 11 | 3.5 | 4 | 9 |
| K6 | 8 | 1 | 6 | 2.1 | 11 | 3.5 | 4 | 9 |
| K7 | 10 | 1 | 7 | 3.1 | 11 | 3.5 | 4 | 10 |
| K8 | 12 | 1 | 10 | 3.3 | 11 | 3.5 | 5 | 10 |
| K9 | 12 | 1 | 10 | 5.0 | 11 | 3.5 | 5 | 10 |
| K10 | 12 | 1 | 10 | 6.0 | 11 | 3.5 | 4 | 9 |
| K11 | 12 | 0 | 10 | 3.2 | 11 | 3.5 | 5 | 7 |
| K12 | 12 | 0.05 | 10 | 3.3 | 11 | 3.5 | 5 | 8 |
| K13 | 12 | 0.5 | 10 | 3.0 | 11 | 3.5 | 5 | 10 |
| K14 | 12 | 2 | 10 | 3.1 | 11 | 3.5 | 5 | 10 |
| K15 | 12 | 3 | 10 | 2.8 | 11 | 3.5 | 5 | 10 |
| K16 | 12 | 6 | 10 | 2.7 | 11 | 3.5 | 4 | 10 |
| K17 | 12 | 10 | 10 | 2.7 | 11 | 3.5 | 3 | 10 |
| K18 | 1 | 1 | 0 | 0.9 | 11 | 4 | 1 | 3 |
| K19 | 10 | 1 | 7 | 3.1 | 11 | 4 | 4 | 10 |
| K20 | 1 | 1 | 0 | 0.8 | 11 | 2.9 | 3 | 1 |
| K21 | 10 | 1 | 7 | 3.0 | 11 | 2.9 | 5 | 10 |
| K22 | 1 | 1 | 0 | 0.8 | 15 | 3.5 | 3 | 1 |
| K23 | 10 | 1 | 7 | 3.0 | 15 | 3.5 | 5 | 10 |

The numbers NL1 and NL2 of lines and the average NcpA are specified on the basis of the results of analysis of a section of the resistor 170 (this will be described in detail later). The component ratio R is the ratio (mass ratio) of the amount of Ti elements to the amount of Zr elements in the resistor 170 (i.e., filler). This ratio is specified as follows: a portion of the resistor 170 is scraped off, and the portion is analyzed by Inductively Coupled Plasma Emission Spectroscopy. The resistors 170 of the samples were formed of a material which contained carbon black as an electrically conductive material, $SiO_2$—$B_2O_3$—$Li_2O$—BaO glass particles as type 1 particles, and $ZrO_2$ particles and $TiO_2$ particles as type 2 particles.

Radio noise evaluation was performed by use of the attenuation of radio noise which was measured according to the BOX method specified in JASO D002-2 (2004). Specifically, five samples having the same configuration and a resistance of 1.40±0.05 (kΩ) were manufactured for each sample No. An evaluation value was determined by use of the average of attenuations at 300 MHz of five samples. An evaluation value was calculated as follows: the average attenuation of sample K16 was taken as a reference (one point), and every time an improvement of the average attenuation as compared with the reference increased by 0.1 dB, one point was added. For example, in the case where an improvement from the average attenuation of sample K16 is equal to or greater than 0.1 dB, and less than 0.2 dB, radio noise evaluation is two points.

Under-load life indicates durability against discharge. In order to evaluate durability, five samples having the same configuration and a resistance of 1.40±0.05 (kΩ) were manufactured for each sample No. Samples were manufactured under the same conditions as those in manufacture of corresponding samples used for evaluation of restraint of radio noise and having the same sample Nos. Samples were connected to a power supply, and multiple discharge was repeated under the following conditions. The following conditions are severer than those of ordinary use.

Temperature: 400 degrees centigrade

Discharge cycle: 60 Hz

Energy output from power supply in one cycle: 400 mJ

In the evaluation test, operation was performed under the above conditions; after the operation, there was measured the electric resistance at the room temperature between the center electrode 120 and the metal terminal member 140. The operation and the measurement of electric resistance were repeated until the electric resistance after operation of at least one of five samples increased to 1.5 times or more the electric resistance before the evaluation test. On the basis of the total operation time when the electric resistance after operation of at least one sample increased to 1.5 times or more the electric resistance before the evaluation test, the following evaluation was made.

Total operation time: Evaluation

Less than 10 hours: 1 point 10 hours to less than 20 hours: 2 points 20 hours to less than 100 hours: 3 points 100 hours to less than 120 hours: 4 points 120 hours to less than 140 hours: 5 points (Hereafter, every time the total operation time increases by 20 hours, one point is added.)

Figure 5:
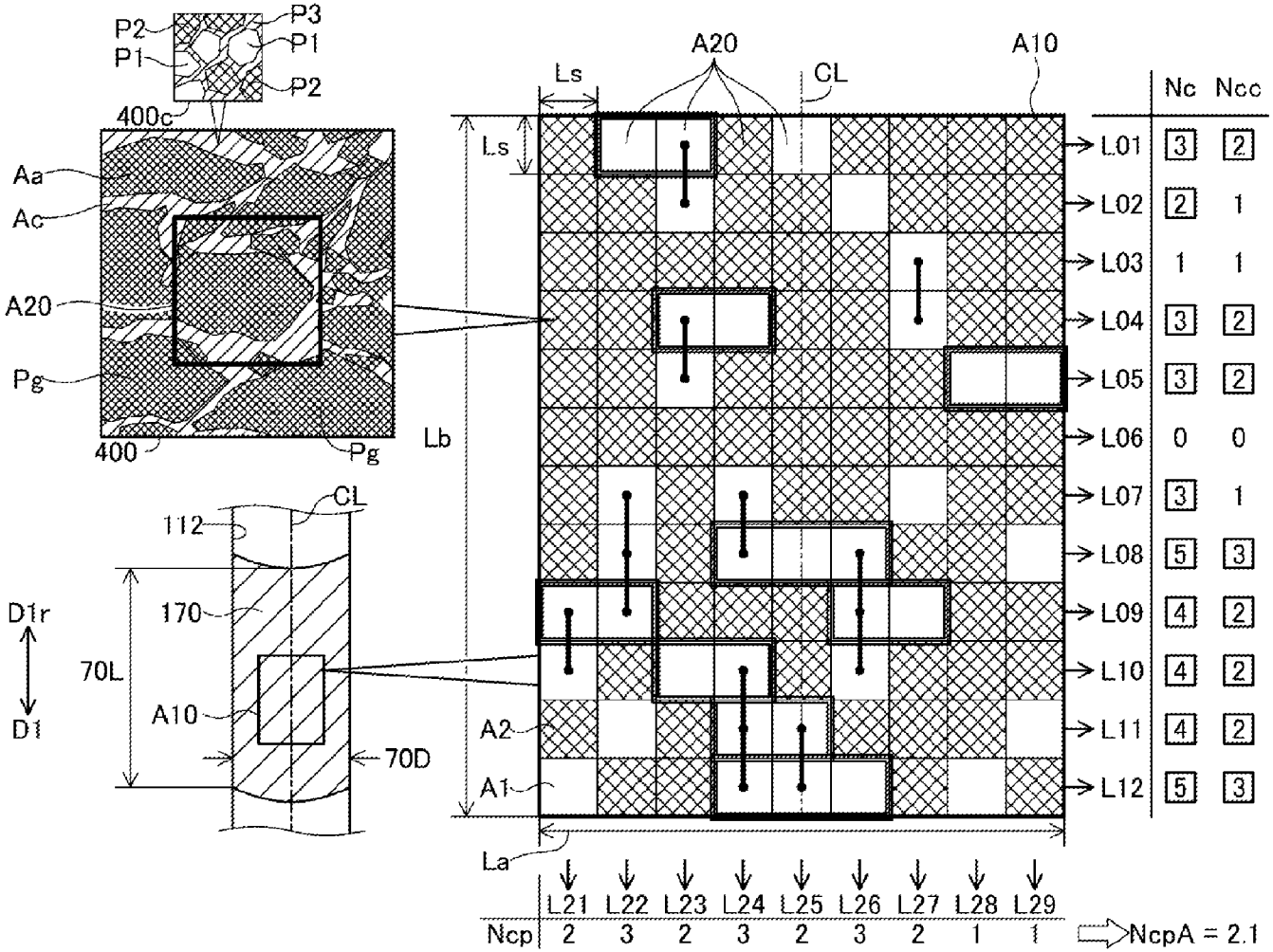
FIG. 5 is an explanatory view for explaining a section of a resistor 170 which contains a center axis CL, and an object region A10 in the section.

Next, the number NL1 of lines and the number NL2 of lines appearing in Table 4 will be described. FIG. 5 is an explanatory view for explaining a section of the resistor 170 which contains the center axis CL, and an object region A10 in the section. FIG. 5 shows, at the lower left, a section which contains the center axis CL of the resistor 170 disposed in the through hole 112. The object region A10 is shown in the illustrated section of the resistor 170. The object region A10 is a rectangular region whose center line is the center axis CL (axial line CL), and the rectangle has two sides parallel to the center axis CL and two sides perpendicular to the center axis CL. The object region A10 is shaped in line symmetry with respect to the center axis CL. The object region A10 is disposed in such a manner as not to protrude from the resistor 170. As illustrated, the end surfaces of the resistor 170 on the forward D1 side and on the rearward D1*r* side, respectively, can be curved. The illustrated resistor length 70L is a length along the center axis CL of that range of the resistor 170 in which a section of the inner circumferential surface of the insulator 110 taken perpendicular to the center axis CL is filled with the resistor 170.

FIG. 5 shows, at right, an enlarged view of the object region A10. The first length La is a length of the object region A10 perpendicular to the center axis CL, and the second length Lb is a length of the object region A10 along the center axis CL. Herein, the first length La is 1,800 μm, and the second length Lb is 2,400 μm.

As illustrated, the object region A10 is divided into a plurality of square regions A20. The square regions A20 have a length Ls of one side of 200 μm. Thus, in the object region A10, the number of the square regions A20 in parallel with the center axis CL is 12, and the number of the square regions A20 in a direction perpendicular to the center axis CL is nine. Hereinafter, a linear region consisting of nine square regions A20 arrayed in a direction perpendicular to the center axis CL is called a lateral linear region. Also, a linear region consisting of 12 square regions A20 arrayed in parallel with the center axis CL is called a longitudinal linear region. As shown in FIG. 5, the object region A10 is divided into 12 lateral linear regions L01 to L12 arrayed toward the forward direction D1. Also, the object region A10 is divided into nine longitudinal linear regions L21 to L29 arrayed in a direction perpendicular to the center axis CL.

FIG. 5 shows, at the upper left, a fragmentary section 400 which contains one square region A20. The fragmentary section 400 is a portion of the section of the resistor 170. As illustrated, the section contains aggregate regions Aa and electrically conductive regions Ac intervening between the aggregate regions Aa. The aggregate regions Aa are hatched relatively dark, and the electrically conductive regions Ac are hatched relatively light.

The aggregate regions Aa are formed primarily of type 1 particles (herein, glass particles). The aggregate regions Aa contain relatively large particulate segments (e.g., segments Pg in FIG. 5). The particulate segments Pg are glass particles. Hereinafter, in the resistor 170, particulate segments having a greatest particle size of 20 μm or more are collectively called "aggregate." In samples which were evaluated in an evaluation test, glass particles (e.g., segments Pg) correspond to aggregate.

The electrically conductive regions Ac are formed primarily of type 2 particles (herein, $ZrO_2$ and $TiO_2$) and an electrically conductive material (herein, carbon). FIG. 5 shows, above the fragmentary section 400, a fragmentary enlarged view 400*c* of the electrically conductive region Ac. As illustrated, the electrically conductive region Ac contains zirconia segments P1 formed of $ZrO_2$, titania segments P2 formed of $TiO_2$, and balance segments P3 formed of other components (e.g., glass which was melted in the course of manufacture). In the illustration, the titania segments P2 and the balance segments P3 are hatched.

In the section, the zirconia segments P1 and the titania segments P2 form particulate regions. Hereinafter, in the resistor 170, particulate segments having a greatest particle size of less than 20 μm are collectively called "filler." In the samples which were evaluated in the evaluation test, the filler of the resistor 170 contains the zirconia segments P1 and the titania segments P2. Material $ZrO_2$ powder of the zirconia segments P1 had an average particle size of 3 μm. Material $TiO_2$ powder of the titania segments P2 had an average particle size of 5 μm. In the completed resistor 170, the average particle size of the zirconia segments P1 and the average particle size of the titania segments P2 were substantially equal to the average particle sizes of the respective material powders.

As mentioned above, an electrically conductive material (herein, carbon) is dispersed while adhering to the filler (e.g., $ZrO_2$ particles). Therefore, the electrically conductive material is distributed on and in the vicinity of the zirconia segments P1; i.e., in the electrically conductive regions Ac. The electrically conductive regions Ac provide electrical conductivity by means of the electrically conductive material. In this manner, the zirconia segments P1 can be said to form paths of electric current in the resistor 170. In other words, at the time of electric discharge, electric current flows primarily through the zirconia segments P1 and their vicinities rather than through the aggregate regions Aa.

In order to specify the number NL1 of lines, the number NL2 of lines, and the average NcpA, the zirconia segments P1 in the object region A10 were identified. The zirconia segments P1 were identified by analyzing the distribution of $ZrO_2$ in the object region A10 by use of a SEM/EDS (scanning electron microscope/energy dispersive X-ray spectrometer). The employed analyzer is a product of JEOL, Ltd., model JSM-6490LA. For the analysis, a sample of the spark plug 100 was cut along a plane which contained the center axis CL, and the section of the resistor 170 was specularly polished. The employed sample was manufactured under the same conditions as those for manufacturing the samples which were evaluated for restraint of radio noise and under-load life. The specularly polished section was analyzed by use of the analyzer. EDS mapping was performed at an acceleration voltage of 20 kV and a sweep count of 50. The results of EDS mapping were stored in the form of black-and-white (i.e., binary) bit map image data. At this time, through the operation menu of the analyzing tool "tool-histogram" of the analyzer, a threshold was determined such that, in the black-and-white image, a region having a value of 20% or more a maximum value is taken as a white region, and a region having a value of less than 20% the maximum value is taken as a black region. Thus-obtained white regions in the image were employed as the zirconia segments P1.

In determining the threshold, the employed upper limit of the threshold was an integer obtained by rounding a value of 20% the maximum value to unit, and the employed lower limit of the threshold was obtained by subtracting one from the upper limit of the threshold. By means of setting the lower limit of the threshold to a value obtained by subtracting one from the upper limit of the threshold, binarization to black and white is possible without generation of an intermediate color (gray) between black and white. For example, in the case of a maximum value of 35, the upper limit of the threshold is set to seven (35×20%), and the lower limit of the threshold is set to six. In this case, a region having a value of seven or more is categorized as a white region, and a region having a value of less than seven is categorized as a black region. In the case of a maximum value of 37 also, similarly, the upper limit of the threshold is set to seven, and the lower limit of the threshold is set to six. In the case of a maximum value of 38, the upper limit of the threshold is set to eight, and the lower limit of the threshold is set to seven.

The number NL1 of type 1 lines in Table 4 was determined by use of the thus-identified zirconia segments P1. Specifically, the area percentage of the zirconia segments P1 was calculated for each of the 108 square regions A20 contained in the object area A10. The square regions A20 having an area percentage of the zirconia segments P1 of 25% or more were categorized as type 1 regions A1, and the square regions A20 having an area percentage of the zirconia segments P1 of less than 25% were categorized as type 2 regions A2. In the example of FIG. 5, the type 2 regions A2 are hatched. In FIG. 5, the number Nc of type 1 regions indicated at the right of the object region A10 is the number of the type 1 regions A1 contained in individual lateral linear regions. For example, the number Nc of type 1 regions of the second lateral linear region L02 is two. As mentioned above, electric current is more likely to flow through the zirconia segments P1 than through the aggregate regions Aa. Therefore, the larger the number Nc of type 1 regions, the more likely electric current is to flow along the corresponding lateral linear region; i.e., in a direction intersecting with the center axis CL.

The number NL1 of type 1 lines in Table 4 is the number of lateral linear regions having a number Nc of type 1 regions of 2 or more (hereinafter, called "type 1 lines"). The larger the number NL1 of type 1 lines, the more likely electric current is to flow through a large number of lateral linear regions (e.g., NL1 pieces of lateral linear regions) along extending directions of the lateral linear regions. Therefore, in the case of a large number NL1 of type 1 lines, electric current which flows through the resistor 170 can flow through intricate paths running through a plurality of lateral linear regions. In the case where electric current flows through intricate paths, radio noise can be restrained as compared with the case where electric current flows through rectilinear paths in parallel with the center axis CL. Presumably, the more intricate the shapes of paths; i.e., the larger the number NL1 of type 1 lines, the larger the effect of restraining radio noise. In the case where electric current flows through intricate paths, electric current can be dispersed in the resistor 170 as compared with the case where electric current flows through rectilinear paths in parallel with the center axis CL. Therefore, presumably, the larger the number NL1 of type 1 lines, the more a local deterioration of the resistor 170 can be restrained.

In FIG. 5, a number Nc of type 1 regions of 2 or more is surrounded by a square. In the example of FIG. 5, the number of lines having a number Nc of type 1 regions of 2 or more; i.e., the number NL1 of type 1 lines, is 10.

The number NL2 of type 2 lines in Table 4 was determined by use of the maximum lateral continuation number Ncc appearing adjacent to the number Nc of type 1 regions in FIG. 5. The maximum lateral continuation number Ncc is the maximum number of the type 1 regions A1 contained in a single lateral continuation segment, which is a segment consisting of consecutive type 1 regions A1 in a single lateral linear region. In FIG. 5, lateral continuation segments are represented by double lines. For example, the fourth lateral linear region L04 has a maximum lateral continuation number Ncc of 2. The larger the maximum lateral continuation number Ncc, the more likely electric current is to flow along the corresponding lateral linear region.

The number NL2 of type 2 lines in Table 4 is the number of lateral linear regions having a maximum lateral continuation number Ncc of 2 or more (hereinafter, called "type 2 lines"). The larger the number NL2 of type 2 lines, the more likely electric current is to flow through a large number of lateral linear regions (e.g., NL2 pieces of lateral linear regions) along extending directions of the lateral linear regions. Therefore, in the case of a large number NL2 of type 2 lines, since electric current which flows through the resistor 170 is apt to flow through intricate paths running through a plurality of lateral linear regions, radio noise can be further restrained. Presumably, the more intricate the shapes of paths; i.e., the larger the number NL2 of type 2 lines, the larger the effect of restraining radio noise. In the case where electric current flows through intricate paths, electric current can be dispersed in the resistor 170 as compared with the case where electric current flows through rectilinear paths in parallel with the center axis CL. In the case where electric current flows through intricate paths, electric current can be dispersed in the resistor 170 as compared with the case where electric current flows through rectilinear paths in parallel with the center axis CL. Therefore, presumably, the larger the number NL2 of type 2 lines, the more a local deterioration of the resistor 170 can be restrained.

In FIG. 5, a maximum lateral continuation number Ncc of 2 or more is surrounded by a square. In the example of FIG. 5, the number of lines having a maximum lateral continuation number Ncc of 2 or more; i.e., the number NL2 of type 2 lines, is eight.

The average NcpA for the maximum longitudinal continuation number Ncp in Table 4 is the average of the maximum longitudinal continuation numbers Ncp of the nine longitudinal linear regions L21 to L29 shown in FIG. 5. The maximum longitudinal continuation number Ncp is the maximum number of the type 1 regions A1 contained in a single lateral continuation segment, which is a segment consisting of consecutive type 1 regions A1 in a single longitudinal linear region. In FIG. 5, longitudinal continuation segments are indicated by bold lines connecting a plurality of the type 1 regions A1 which constitute the individual longitudinal connection segments. For example, the fourth longitudinal linear region L24 has a maximum longitudinal continuation number Ncp of 3. Also, in the example of FIG. 5, the average NcpA of nine maximum longitudinal continuation numbers Ncp is 2.1. The larger the maximum longitudinal continuation number Ncp, the more likely electric current is to flow along the corresponding longitudinal linear region.

Image analyzing software analySIS Five (trademark), a product of Soft Imaging System GmbH, was used for analyzing bit map image data; i.e., for calculating areas in order to identify the type 1 regions A1 and the type 2 regions A2 and calculate the average NcpA, and for calculating the number NL1 of type 1 lines, the number NL2 of type 2 lines, and the average NcpA. The number NL1 of lines, the number NL2 of lines, and the average NcpA in Table 4 are averages of the results of analysis of two different object regions A10 on the section of one sample.

C-2. Number NL1 of Type 1 Lines and Evaluation Results

Samples K1 to K10 in Table 4 had a number NL1 of type 1 lines of 1, 5, 5, 7, 7, 8, 10, 12, 12, and 12, respectively. The 10 samples had the same component ratio R of 1, the same connection length 300L of 11 mm, and the same resistor diameter 70D of 3.5 mm. Also, the resistor length 70L (FIG. 5) was about 8 mm.

As is understood from the results of evaluation of samples K1 to K10, the samples having a large number NL1 of type 1 lines were superior in radio noise evaluation to the samples having a small number NL1 of type 1 lines. Also, the samples having a large number NL1 of type 1 lines were superior in under-load life evaluation to the samples having a small number NL1 of type 1 lines. Presumably, this is for the following reason: as mentioned above, the larger the number NL1 of type 1 lines, the greater the extent of intricacy of the shape of paths of electric current.

The number NL1 of type 1 lines capable of attaining radio noise evaluation better than 2 points and under-load life evaluation better than 2 points was 5, 7, 8, 10, and 12. A value selected arbitrarily from these values can be employed as the lower limit of a preferred range (lower limit or greater, upper limit or less) of the number NL1 of type 1 lines. For example, a number NL1 of type 1 lines of 5 or more can be employed. Of these values, any value equal to or greater than the lower limit can be employed as the upper limit of a preferred range of the number NL1 of type 1 lines. For example, the number NL1 of type 1 lines can assume a value of 12 or less.

In view of improvement of radio noise evaluation, presumably, thin intricate paths of electric current are preferred for electric current which flows through the resistor 170. However, thin paths of electric current are highly likely to break upon exposure to heat and vibration (i.e., under-load life is short) as compared with thick paths of electric current. Thus, as has been described with reference to FIG. 5, the present evaluation test was performed by use of the area percentage of the zirconia segments P1 in the square region A20 which has a side length of 200 μm and is thus large as compared with filler, in order to categorize the square region A20 as the type 1 region A1 in which electric current flows relatively easily or as the type 2 region A2 in which electric current rather encounters difficulty in flowing. In this case, if paths of electric current formed of the zirconia segments P1 are excessively thin, the square region A20 is not categorized as the type 1 region A1; and, if paths of electric current are thick to a certain extent, the square region A20 is categorized as the type 1 region A1. By use of such type 1 region A1, a parameter correlated with both radio noise evaluation and under-load life evaluation; i.e., the number NL1 of type 1 lines, was able to be obtained. Notably, if the square region A20 has a side length in excess of 200 μm, even in the case of formation of those paths of electric current which less influence restraint of radio noise (e.g., thick paths of electric current extending in parallel with the center axis CL), the number NL1 of type 1 lines increases. Therefore, presumably, correlation between the number NL1 of type 1 lines and radio noise evaluation is weakened. The same also applies to the number NL2 of type 2 lines, which will be described later.

C-3. Number NL2 of Type 2 Lines and Evaluation Results

Samples K1 to K10 in Table 4 had a number NL2 of type 2 lines of 0, 3, 5, 3, 5, 6, 7, 10, 10, and 10, respectively. As is understood from the results of evaluation of these samples, the samples having a large number NL2 of type 2 lines were superior in radio noise evaluation and under-load life to the samples having a small number NL2 of type 2 lines. Presumably, this is for the following reason: as mentioned above, the larger the number NL2 of type 2 lines, the greater the extent of intricacy of the shape of paths of electric current.

The number NL2 of type 2 lines capable of attaining radio noise evaluation better than 2 points was 3, 5, 6, 7, and 10. A value selected arbitrarily from these values can be employed as the lower limit of a preferred range (lower limit or greater, upper limit or less) of the number NL2 of type 2 lines. For example, a number NL2 of type 2 lines of 3 or more can be employed. The number NL2 of type 2 lines capable of attaining under-load life evaluation better than 6 points was 5, 6, 7, and 10. Therefore, preferably, a number NL2 of type 2 lines of 5 or more is employed. The number of NL2 of type 2 lines capable of attaining the best under-load life evaluation of 10 points was 7, and 10. Therefore, preferably, a number NL2 of type 2 lines of 7 or more is employed. Presumably, the larger the number NL2 of type 2 lines, the better the under-load life evaluation. Thus, presumably, the number NL2 of type 2 lines can assume a theoretically greatest value of 12 or less. Also, of the above-mentioned evaluated values (e.g., 3, 5, 6, 7, and 10), any value equal to or greater than the lower limit can be employed as the upper limit C-4. Component Ratio R (Ti/Zr) and Evaluation Results Samples K11 to K17 in Table 4 had a component ratio R (Ti/Zr) of 0, 0.05, 0.5, 2, 3, 6, and 10, respectively. The seven samples had the same number NL1 of type 1 lines of 12, the same number NL2 of type 2 lines of 10, the same connection length 300L of 11 mm, and the same resistor diameter 70D of 3.5 mm. Other configurational features of samples K11 to K17 were similar to those of the above-mentioned samples K1 to K10.

As is understood from the results of evaluation of samples K11 to K17, the samples having a large component ratio R were superior in under-load life evaluation to the samples having a small component ratio R. Presumably, this is for the following reason: since paths of electric current running through $TiO_2$ increase with the percentage of $TiO_2$, electric current can be dispersed in the resistor 170, and deterioration of the resistor 170 can be restrained. The samples having a small component ratio R were superior in radio noise evaluation to the samples having a large component ratio R. Presumably, this is for the following reason: since paths of electric current running through $TiO_2$ decrease as the percentage of $TiO_2$ reduces, the paths of electric current in the resistor 170 become intricate.

In view of the results of evaluation of samples K1 to K10 in addition to samples K11 to K17, an under-load life evaluation of 8 points or higher was implemented at a component ratio R of 0.05, 0.5, 1, 2, 3, 6, and 10. Also, a radio noise evaluation of 4 points or higher was implemented at a component ratio R of 0, 0.05, 0.5, 1, 2, 3, and 6. Six values of the component ratio R appearing in both were 0.05, 0.5, 1, 2, 3, and 6. A value selected arbitrarily from these six values can be employed as the lower limit of a preferred range (lower limit or greater, upper limit or less) of the component ratio R. Of the six values, any value equal to or greater than the lower limit can be employed as the upper limit. For example, the component ratio R can assume a value of 0.05 to 6. More preferably, the component ratio R can assume a value of 0.5 to 6. Far more preferably, the component ratio R can assume a value of 0.5 to 3.

Meanwhile, samples K1 to K10 had a component ratio R of 1, which is greater than the lower limit of the above-mentioned preferred range and is smaller than the upper limit. As is understood from the results of evaluation of samples K1 to K10, at a component ratio R of 1, various combinations of the number NL1 of type 1 lines and the number NL2 of type 2 lines could implement a radio noise evaluation of 4 points or higher and an under-load life evaluation of 8 points or higher. Thus, presumably, even in the case where the number NL1 of type 1 lines differs from 12, which is the number NL1 of type 1 lines of samples K11 to K17, the above-mentioned preferred range of the component ratio R can be applied. Similarly, even in the case where the number NL2 of type 2 lines differs from 10, which is the number NL2 of type 2 lines of samples K11 to K17, the above-mentioned preferred range of the component ratio R can be applied.

C-5. Resistor Diameter 70D and Evaluation Results

Samples K18 and K19 in Table 4 had a resistor diameter 70D of 4 mm, which is greater than the resistor diameters 70D (3.5 mm) of samples K1 to K17. Sample K18 was configured to have NL1=1, NL2=0, and R=1; thus, the two parameters NL1 and NL2 failed to fall within the above-mentioned preferred ranges, respectively. Sample K18 had a radio noise evaluation of 1 point and an under-load life evaluation of 3 points. By contrast, sample K19 was configured to have NL1=10, NL2=7, and R=1; thus, the three parameters NL1, NL2, and R fell within the above-mentioned preferred ranges, respectively. Sample K19 had a radio noise evaluation of 4 points, which is better than that of sample K18, and an under-load life evaluation of 10 points, which is better than that of sample K18.

Samples K20 and K21 in Table 4 had a resistor diameter 70D of 2.9 mm, which is smaller than the resistor diameters 70D (3.5 mm) of samples K1 to K17. Sample K20 was configured to have NL1=1, NL2=0, and R=1; thus, the two parameters NL1 and NL2 failed to fall within the above-mentioned preferred ranges, respectively. Sample K20 had a radio noise evaluation of 3 points and an under-load life evaluation of 1 point. By contrast, sample K21 was configured to have NL1=10, NL2=7, and R=1; thus, the three parameters NL1, NL2, and R fell within the above-mentioned preferred ranges, respectively. Sample K21 had a radio noise evaluation of 5 points, which is better than that of sample K20, and an under-load life evaluation of 10 points, which is better than that of sample K20.

Samples K18 to K21 had the same connection length 300L of 11 mm. Also, samples K18 to K21 had substantially the same resistor length 70L (FIG. 5) of 8 mm.

Generally, since the resistor 170 having a small resistor diameter 70D is smaller in surface area than the resistor 170 having a large resistor diameter 70D, the resistor 170 having a small resistor diameter 70D encounters difficulty in releasing, to other members such as the insulator 110, heat generated as a result of flow of electric current in the resistor 170. That is, the resistor 170 having a small resistor diameter 70D is apt to suffer deterioration in under-load life evaluation. Also, in the case of the resistor 170 having a small resistor diameter 70D, since the lengths of paths of electric current extending in directions intersecting with the center axis CL are limited to a short range, restraint of radio noise is apt to deteriorate. Meanwhile, as shown in Table 4, at three resistor diameters 70D of 2.9 mm, 3.5 mm, and 4 mm, a radio noise evaluation of 4 points or higher and an under-load life evaluation of 8 points or higher could be implemented. In this manner, the resistor diameter 70D can assume a value of 4 mm or less, can assume a smaller value of 3.5 mm or less, and can assume a far smaller value of 2.9 mm or less. In the case where any value (e.g., 2.9 mm) equal to or less than the upper limit is selected from the three values as the lower limit, the resistor diameter 70D can assume a value equal to or greater than the lower limit In view of the fact that, generally, practical use is possible with a radio noise evaluation of 2 points or higher and an under-load life evaluation of 2 points or higher, presumably, the allowable range of the resistor diameter 70D can be expanded to a wide range which contains the three values (2.9 mm, 3.5 mm, and 4 mm). For example, presumably, the resistor diameter 70D can assume various values equal to or greater than a first length La of the object region A10 of 1.8 mm. In view of practical sizes of the spark plug 100, presumably, the resistor diameter 70D can assume various values equal to or less than 6 mm. In any case, presumably, by means of setting at least the number NL1 of type 1 lines to a value in the above-mentioned preferred range, good radio noise evaluation (e.g., 2 points or higher) and good under-load life evaluation (e.g., 2 points or higher) can be implemented. Preferably, in addition to the number NL1 of type 1 lines, the number NL2 of type 2 lines is set to a value in the above-mentioned preferred range. Also, preferably, the component ratio R is set to a value in the above-mentioned preferred range.

C-6. Connection Length 300L and Evaluation Results

Samples K22 and K23 in Table 4 had a connection length 300L of 15 mm, which is greater than the connection lengths 300L (11 mm) of samples K1 to K21. A connection length 300L of 15 mm was implemented by moving the forward end (end on the forward direction D1 side) of the metal terminal member 140 in the rearward direction D1*r* and increasing the length of the resistor 170 (specifically, the resistor length 70L in FIG. 5) along the center axis CL. Samples K1 to K21 had substantially the same shape and size of the first seal 160. Similarly, samples K1 to K21 had substantially the same shape and size of the second seal 180.

Sample K22 was configured to have NL1=1, NL2=0, R=1, and 70D=3.5 mm; thus, the two parameters NL1 and NL2 failed to fall within the above-mentioned preferred ranges, respectively. Sample K22 had a radio noise evaluation of 3 points and an under-load life evaluation of 1 point. By contrast, sample K23 was configured to have NL1=10, NL2=7, R=1, and 70D=3.5 mm; thus, the four parameters NL1, NL2, R, and 70D fall within the above-mentioned preferred ranges, respectively. Sample K23 had a radio noise evaluation of 5 points, which is better than that of sample K22, and an under-load life evaluation of 10 points, which is better than that of sample K22.

Generally, manufacturing the connection 300 (including the resistor 170) having a long connection length 300L is more difficult than manufacturing the connection 300 having a short connection length 300L. For example, in some cases, a material of the connection 300 (e.g., the resistor 170) disposed in the through hole 112 is compressed by use of a rod inserted into the through hole 112 from the rear opening 114 of the through hole 112. In the case of a long connection length 300L, pressure applied for compression is apt to be dispersed at an intermediate portion of the connection 300. As a results, in some cases, the material of the resistor 170 fails to be appropriately compressed, resulting in deterioration in restraint of radio noise and deterioration in durability. Meanwhile, as shown in Table 4, at two connection lengths 300L of 11 mm and 15 mm, a radio noise evaluation of 4 points or higher and an under-load life evaluation of 8 points or higher could be implemented. In this manner, the connection length 300L can assume a value of 11 mm or more and can assume a greater value of 15 mm or more. Also, in the case where any value (e.g., 15 mm) equal to or greater than the lower limit is selected from the two values as the upper limit, the connection length 300L can assume a value equal to or less than the upper limit.

In view of the fact that, generally, practical use is possible with a radio noise evaluation of 2 points or higher and an under-load life evaluation of 2 points or higher, presumably, the allowable range of the connection length 300L can be expanded to a wide range which contains the two values (11 mm and 15 mm). For example, presumably, the connection length 300L can assume various values equal to or greater than 5 mm. Also, presumably, the connection length 300L can assume various values equal to or less than 30 mm. In any case, presumably, by means of setting at least the number NL1 of type 1 lines to a value in the above-mentioned preferred range, good radio noise evaluation (e.g., 2 points or higher) and good under-load life evaluation (e.g., 2 points or higher) can be implemented. Preferably, in addition to the number NL1 of type 1 lines, the number NL2 of type 2 lines is set to a value in the above-mentioned preferred range. Also, preferably, the component ratio R is set to a value in the above-mentioned preferred range. Also, preferably, the resistor diameter 70D is set to a value in the above-mentioned presumed allowable range.

C-7. Average NcpA for Maximum Longitudinal Continuation Number Ncp and Evaluation Results According to the evaluation results of samples K1 to K23 in Table 4, the average NcpA capable of attaining a radio noise evaluation of 2 points or higher was 13 values of 0.8, 1.8, 1.9, 2.0, 2.1, 2.7, 2.8, 3.0, 3.1, 3.2, 3.3, 5.0, and 6.0. A value selected arbitrarily from these 13 values can be employed as the lower limit of a preferred range (lower limit or greater, upper limit or less) of the average NcpA. Of the 13 values, any value equal to or greater than the lower limit can be employed as the upper limit. Presumably, the smaller the average NcpA, the greater the extent of intricacy of paths of electric current. Therefore, presumably, the average NcpA can assume a value (e.g., various values equal to or greater than zero) smaller than the minimum value (0.8) among the above-mentioned 13 values. For example, presumably, the average NcpA can assume a value of zero to 6.0. However, presumably, by setting the number NL1 of type 1 lines to a value in the above-mentioned preferred range, the average NcpA for the maximum longitudinal continuation number Ncp also assumes a value greater than zero.

As is understood from the results of evaluation of sample K10 and other samples, at an average NcpA of 5.0 or less, a radio noise evaluation of 5 points could be implemented; however, at an average NcpA of 6.0, a lower radio noise evaluation of 4 points resulted. Presumably, this is for the following reason: as a result of increase in the average NcpA, electric current flows easily along the longitudinal linear regions; as a result, paths of electric current become simple. Thus, presumably, by means of the average NcpA for the maximum longitudinal continuation number Ncp assuming a value of 5.0 or less, better radio noise evaluation can be implemented.

In any case, presumably, by means of setting at least the number NL1 of type 1 lines to a value in the above-mentioned preferred range, good radio noise evaluation (e.g., 2 points or higher) and good under-load life evaluation (e.g., 2 points or higher) can be implemented. Preferably, in addition to the number NL1 of type 1 lines, the number NL2 of type 2 lines is set to a value in the above-mentioned preferred range. Also, preferably, the component ratio R is set to a value in the above-mentioned preferred range. Also, preferably, the resistor diameter 70D is set to a value in the above-mentioned presumed allowable range. Also, preferably, the connection length 300L is set to a value in the above-mentioned presumed allowable range.

D. Second Evaluation Test for Second Embodiment

D-1. Outline of Second Evaluation Test

The second evaluation test evaluated samples of the spark plug 100 of the embodiment with regard to relations among configuration, restraint of radio noise, and under-load life. Table 5 shown below shows relations among sample numbers, the number NL1 of type 1 lines, the component ratio R (Ti/Zr), the number NL2 of type 2 lines, the type 1 region ratio RA1, the expected number NcE of type 1 regions, the expected maximum lateral continuation number NccE, continuity evaluation, the average maximum lateral continuation number NccA, the connection length 300L (unit: mm), the resistor diameter 70D (unit: mm), radio noise evaluation, and under-load life evaluation. The second evaluation test evaluated five kinds of samples numbered from T1 to T5.

TABLE 5

| No. | Number of type 1 lines NL1 (Nc ≥ 2) | Component ratio R (Ti/Zr) | Number of type 2 lines NL2 (Ncc ≥ 2) | Type 1 region ratio RA1 | Expected number of type 1 regions NcE | Expected maximum lateral continuation number NccE |
|---|---|---|---|---|---|---|
| T1 | 12 | 1 | 12 | 0.935 (101/108) | 8 | 6.2 |
| T2 | 6 | 1 | 6 | 0.324 (35/108) | 3 | 1.67 |
| T3 | 10 | 1 | 8 | 0.343 (37/108) | 3 | 1.67 |
| T4 | 12 | 1 | 10 | 0.454 (49/108) | 4 | 2.21 |
| T5 | 12 | 1 | 10 | 0.454 (49/108) | 4 | 2.21 |

| No. | Lateral linear region: Continuity evaluation | Lateral linear region: Average maximum lateral continuation number NccA | Connection length 300 L | Resistor diameter 70 D | Radio noise evaluation | Under-load life evaluation |
|---|---|---|---|---|---|---|
| T1 | A | 7.33 | 11 | 3.5 | 5 | 10 |
| T2 | A | 1.83 | 11 | 3.5 | 5 | 10 |
| T3 | A | 1.75 | 11 | 3.5 | 5 | 10 |
| T4 | A | 2.50 | 11 | 3.5 | 5 | 10 |
| T5 | B | 2.18 | 11 | 3.5 | 5 | 5 |

Parameters NL1, R, NL2, 300L, and 70D in Table 5 are similar to those in Table 4. Radio noise evaluation was determined by the same method as that of the first evaluation test in Table 4. Under-load life evaluation was determined by the method of the first evaluation test in Table 4 except that "energy output from power supply in one cycle" was changed from 400 mJ to 600 mJ. That is, the second evaluation test evaluated under-load life under conditions severer than those of the first evaluation test.

Next, other parameters in Table 5 will be described. The type 1 region ratio RA1 is the ratio of the total number of type 1 regions A1 to the total number of square regions A20 in the object region A10 (FIG. 5). As mentioned above, the total number of square regions A20 is 108. The type 1 region ratio RA1 column in Table 5 shows in parentheses the total number of square regions A20 "108" and the total number of type 1 regions A1. For example, sample T1 has a total number of type 1 regions A1 of 101.

The expected number NcE of type 1 regions is an expected value of the number Nc of type 1 regions (i.e., the number of type 1 regions A1 contained in one lateral linear region). The expected number NcE of type 1 regions is calculated by INT (9*RA1). The function "INT" rounds an argument to unit to obtain an integer. The operator "*" indicates multiplication (the same also applies to the following description). The numeral "9" is the total number of square regions A20 contained in one lateral linear region. The thus-calculated expected number NcE of type 1 regions indicates the total number of type 1 regions A1 contained in one lateral linear region in the case where the type 1 regions A1 in a quantity specified by the type 1 region ratio RA1 are uniformly distributed in the object region A10.

The expected maximum lateral continuation number NccE (hereinafter, may be called "expected lateral continuation value NccE") is an expected value of the maximum lateral continuation number Ncc (i.e., the maximum number of type 1 regions A1 contained in one lateral continuation segment). The expected lateral continuation value NccE is calculated from the maximum lateral continuation number Ncc which is feasible on the basis of the expected number NcE of type 1 regions, and from the combinational number CNcc for disposition of type 1 regions A1 which implements the maximum lateral continuation number Ncc. Specifically, the expected lateral continuation value NccE is obtained by dividing the sum of "Ncc*CNcc" values with respect to all feasible Ncc values by the sum of "CNcc" values with respect to all feasible Ncc values. That is, the expected lateral continuation value NccE is the average of the maximum lateral continuation numbers Ncc in a plurality of feasible disposition patterns of the type 1 regions A1 and the type 2 regions A2. Incidentally, the total number of the type 1 regions A1 contained in one lateral linear region is fixed to the expected number NcE of type 1 regions, irrespective of the maximum lateral continuation number Ncc. The maximum lateral continuation number Ncc which is feasible on the basis of the expected number NcE of type 1 regions is selected from values greater than zero and equal to or less than the expected number NcE of type 1 regions, according to the expected number NcE of type 1 regions.

First, a case of an expected number NcE of type 1 regions of "4" will be described. In this case, the feasible maximum lateral continuation number Ncc is "4," "3," "2," and "1." The combinational numbers CNcc for these maximum lateral continuation numbers Ncc will be described below.

In the case of Ncc=4, one lateral linear region (i.e., nine square regions A20) is divided into one lateral continuation segment (consisting of four type 1 regions A1) and five type 2 regions A2. One lateral continuation segment and five type 2 regions A2 are disposed in a row. The position of one lateral continuation segment is selected from six candidate positions indicated by five type 2 regions A2 disposed in a row. If one type 2 region A2 is represented by letter "O," and a candidate position of the lateral continuation segment is represented by letter "X," the disposition of the type 2 regions A2 (O) and the candidate positions (X) is represented by "XOXOXOXOXOX." The combinational number CNcc for disposition of type 1 regions A1 which implements "Ncc=4" is similar to permutations (${}_6P_1$=6) in selecting the position of one lateral continuation segment from six candidate positions (X).

In the case of Ncc=3, one lateral linear region is divided into one lateral continuation segment (consisting of three type 1 regions A1), one type 1 region A1, and five type 2 regions A2. The lateral continuation segment and one type 1 region A1 are not allowed to be disposed adjacent to each other. In this case, the combinational number CNcc is similar to permutations (${}_6P_2$=30) in selecting the position of one lateral continuation segment and the position of one type 1 region A1 from six candidate positions.

In the case of Ncc=2, one lateral linear region can be divided into the following two patterns.

First pattern: two lateral continuation segments and five type 2 regions A2.

Second pattern: one lateral continuation segment, two type 1 regions A1, and five type 2 regions A2.

In either pattern, the one lateral continuation segment consists of two type 1 regions A1.

In the first pattern, two lateral continuation segments are not allowed to be disposed adjacent to each other. Also, two lateral continuation segments cannot be distinguished from each other. Therefore, the combinational number CNcc is equal to a number obtained by dividing permutations (${}_6P_2$) in selecting the positions of two lateral continuation segments from six candidate positions by permutations (${}_2P_2$=2!) of two indistinguishable lateral continuation segments. Specifically, CNcc=${}_6P_2$/2!=30/2=15.

In the second pattern, the lateral continuation segment and the type 1 region A1 are not allowed to be disposed adjacent to each other. Also, two type 1 regions A1 are not allowed to be disposed adjacent to each other. Additionally, two type 1 regions A1 cannot be distinguished from each other. Therefore, the combinational number CNcc is equal to a number obtained by dividing permutations (${}_6P_3$) in selecting three positions of one lateral continuation segment and two type 1 regions A1 from six candidate positions by permutations (${}_2P_2$=2!) of two indistinguishable type 1 regions A1. Specifically, CNcc=${}_6P_3$/2!=120/2=60.

Thus, in the case of Ncc=2, the final combinational number CNcc is 75 (=15+60).

In the case of Ncc=1, one lateral linear region is divided into four type 1 regions A1 and five type 2 regions A2. Two or more type 1 regions A1 are not allowed to be disposed continuously. Also, four type 1 regions A1 cannot be distinguished from one another. Therefore, the combinational number CNcc is equal to a number obtained by dividing permutations (${}_6P_4$) in selecting the positions of four type 1 regions A1 from six candidate positions by permutations (4$P_4$=4!) of four indistinguishable type 1 regions A1. Specifically, CNcc=${}_6P_4$/4!=360/24=15.

Thus, the total number of dispositions of four type 1 regions A1 (i.e., the total value of combinational numbers CNcc) in the case of an expected number NcE of type 1 regions of 4 is 126 (=6+30+75+15). The expected lateral continuation value NccE is calculated as follows.

$$\Sigma(Ncc*CNcc)=(4*6)+(3*30)+(2*75)+(1*15)=24+90+150+15=279$$

$$NccE=\Sigma(Ncc*CNcc)/\Sigma(CNcc)=279/126=2.21$$

(The operator "Σ" means the sum of all feasible values of Ncc (the same also applies to the following description)).

In this manner, in the case of an expected number NcE of type 1 regions of "4," the expected lateral continuation value NccE is 2.21.

Next, a case of an expected number NcE of type 1 regions of "8" will be described. In this case, the feasible maximum lateral continuation number Ncc is "8," "7," "6," "5," and "4." A Ncc of 3 or less cannot be used. In the case of Ncc=3, eight type 1 regions A1 are divided into at least three mutually separated segments (three segments have a total number of type 1 regions A1 of 3, 3, and 2, respectively). In order to separate the three segments from one another, at least two type 2 regions A2 are required. Thus, one lateral linear region must contain 10 square regions A20. However, as mentioned above, since one lateral linear region contains nine square regions A20 in total, Ncc=3 cannot be implemented. The same also applies to the case of a maximum lateral continuation number Ncc of 2 or less.

In the case of Ncc=8, one lateral linear region is divided into one lateral continuation segment (consisting of eight type 1 regions A1) and one type 2 region A2. If one type 2 region A2 is represented by the letter "O," and a candidate position of one lateral continuation segment is represented by letter "X," the disposition of the type 2 region A2 (O) and the candidate positions (X) is represented by "XOX." The combinational number CNcc for disposition of type 1 regions A1 which implements "Ncc=8" is similar to permutations (${}_2P_1$=2) in selecting the position of one lateral continuation segment from two candidate positions (X).

In the case of Ncc=7, one lateral linear region is divided into one lateral continuation segment (consisting of seven type 1 regions A1), one type 1 region A1, and one type 2 region A2. The lateral continuation segment and the type 1 region A1 are not allowed to be disposed adjacent to each other. Therefore, the combinational number CNcc is similar to permutations (${}_2P_2$=2) in selecting the position of one lateral continuation segment and the position of one type 1 region A1 from two candidate positions.

In the case of Ncc=6, one lateral linear region is divided into two lateral continuation segments of different sizes and one type 2 region A2. Two lateral continuation segments have a total number of type 1 regions A1 of 6 and 2, respectively. Similarly, in the case of Ncc=5, one lateral linear region is divided into two lateral continuation segments of different sizes and one type 2 region A2. Two lateral continuation segments have a total number of type 1 regions A1 of 5 and 3, respectively. In these cases, the combinational number CNcc is similar to permutations ($_2P_2$=2) in selecting the positions of two lateral continuation segments from two candidate positions.

In the case of Ncc=4, one lateral linear region is divided into two lateral continuation segments of the same size and one type 2 region A2. Each of two lateral continuation segments has a total number of type 1 regions A1 of 4. Two lateral continuation segments cannot be distinguished from each other. Therefore, the combinational number CNcc is equal to a number (specifically, "1") obtained by dividing permutations ($_2P_2$) in selecting the positions of two lateral continuation segments from two candidate positions by permutations ($_2P_2$=2!) of two indistinguishable lateral continuation segments.

Thus, the total number of dispositions of eight type 1 regions A1 (i.e., the total value of combinational numbers CNcc) in the case of an expected number NcE of type 1 regions of 8 is 9 (=2+2+2+2+1). The expected lateral continuation value NccE is calculated as follows.

$$\Sigma(Ncc*CNcc)=(8*2)+(7*2)+(6*2)+(5*2)+(4*1)=16+14+12+10+4=56$$

$$NccE=\Sigma(Ncc*CNcc)/\Sigma(CNcc)=56/9=6.2$$

In this manner, in the case of an expected number NcE of type 1 regions of "8," the expected lateral continuation value NccE is 6.2.

Also, in the case of the expected number NcE of type 1 regions different from "4" and "8," the expected lateral continuation value NccE is similarly calculated. Generally, the expected maximum lateral continuation number NccE can be calculated as follows.

(1) The expected number NcE of type 1 regions is calculated from the total number of type 1 regions A1 contained in the object region A10. For example, the type 1 region ratio RA1 is calculated from the total number of type 1 regions A1 contained in the object region A10, and the expected number NcE of type 1 regions is calculated from the type 1 region ratio RA1.

(2) On the basis of the expected number NcE of type 1 regions, feasible maximum lateral continuation numbers Ncc are specified.

(3) There is calculated the combinational number CNcc for disposition of type 1 regions A1 which implements each of the feasible maximum lateral continuation numbers Ncc. For example, one lateral linear region is divided into a plurality of elements according to the expected number NcE of type 1 regions and the maximum lateral continuation number Ncc; then, on the basis of the results of the division, there is calculated the combinational number CNcc for disposition of NcE pieces of type 1 regions A1 which implements the maximum lateral continuation number Ncc.

(4) The expected lateral continuation value NccE is calculated according to the arithmetic expression "NccE=Σ(Ncc*CNcc)/Σ(CNcc)."

Next, other parameters in Table 5 will be described. The average maximum lateral continuation number NccA (hereinafter, may be called "average lateral continuation value NccA") is the average of maximum lateral continuation numbers Ncc of 12 lateral linear regions. The judgment of continuity shows the results of comparison between the average lateral continuation value NccA and the expected lateral continuation value NccE. "Grade A" shows "NccA>NccE," and "Grade B" shows "NccA≤NccE." Continuity evaluated as Grade A means that the average NccA of actually measured maximum lateral continuation numbers Ncc is greater than the expected value NccE of the maximum lateral continuation number Ncc. That is, Grade A indicates good continuity of the type 1 regions A1 in a lateral linear region. In this case, presumably, electric current flows easily along the lateral linear region.

D-2. Constitution of Resistor 170 and Evaluation Results

As shown in Table 5, the continuity of samples T1 to T5 was evaluated as Grade A, Grade A, Grade A, Grade A, and Grade B, respectively. As is understood from the results of evaluation of these samples, in the case of continuity evaluated as Grade B, under-load life evaluation assumed 5 points; by contrast, in the case of continuity evaluated as Grade A, under-load life evaluation assumed 10 points. Presumably, this is for the following reason: in the case of continuity evaluated as Grade A, as mentioned above, since the type 1 regions A1 contained in a lateral linear region have good continuity, electric current is apt to be dispersed along lateral linear regions.

Also, as mentioned above, the second evaluation test is greater in "energy output from power supply in one cycle" than the first evaluation test. Even under such a severe condition, in the case of continuity evaluated as Grade A; i.e., in the case where the average lateral continuation value NccA is greater than the expected lateral continuation value NccE, under-load life evaluation of 10 points could be implemented. In this manner, it is preferred that the average lateral continuation value NccA is greater than the expected lateral continuation value NccE. However, since the second evaluation test was conducted under relatively severe conditions, it is presumed that, even though the average lateral continuation value NccA is equal to or less than the expected lateral continuation number NccE, practical under-load life can be implemented.

Samples T1 to T5 had an average lateral continuation value NccA of 7.33, 1.83, 1.75, 2.50, and 2.18, respectively. A value selected arbitrarily from these five values can be employed as the lower limit of a preferred range (lower limit or greater, upper limit or less) of the average lateral continuation value NccA. Also, of the five values, any value equal to or greater than the lower limit can be employed as the upper limit. Of the five average lateral continuation values NccA, 1.75, 1.83, 2.50, and 7.33 could implement under-load life evaluation of 10 points. The upper limit and the lower limit of a preferred range of the average lateral continuation value NccA may be selected from these four values. However, since the second evaluation test was conducted under relatively severe conditions, presumably, even though the average lateral continuation value NccA fails to fall within the preferred range, practical under-load life can be implemented.

Samples T1 to T5 had an expected lateral continuation value NccE of 6.2, 1.67, 1.67, 2.21, and 2.21, respectively. A value selected arbitrarily from these five values can be employed as the lower limit of a preferred range (lower limit or greater, upper limit or less) of the expected lateral continuation value NccE. Also, of the five values, any value equal to or greater than the lower limit can be employed as the upper limit. Of the five expected lateral continuation values NccE, 1.67, 2.21, and 6.2 could implement under-load life evaluation of 10 points. The upper limit and the lower limit of a preferred range of the expected lateral continuation value NccE may be selected from these three values. However, since the second evaluation test was conducted under relatively severe conditions, presumably, even though the expected lateral continuation value NccE fails to fall within the preferred range, practical under-load life can be implemented.

The parameters NL1, R, NL2, 300L, and 70D of samples T1 to T5 assumed the values shown in Table 5. As mentioned above, since the second evaluation test was conducted under relatively severe conditions, presumably, even though the parameters NL1, R, NL2, 300L, and 70D assume values different from those of the samples, practical under-load life can be implemented. In any case, presumably, by means of setting at least the number NL1 of type 1 lines to a value in the above-mentioned preferred range, good radio noise evaluation (e.g., 2 points or higher under the conditions of the first evaluation test) and good under-load life evaluation (e.g., 2 points or higher under the conditions of the first evaluation test) can be implemented. Preferably, in addition to the number NL1 of type 1 lines, the number NL2 of type 2 lines is set to a value in the above-mentioned preferred range. Also, preferably, the component ratio R is set to a value in the above-mentioned preferred range. Also, preferably, the resistor diameter 70D is set to a value in the above-mentioned presumed allowable range. Also, preferably, the connection length 300L is set to a value in the above-mentioned presumed allowable range.

E. Modifications (1) The material of the resistor 170 is not limited to the above-mentioned material, and various materials can be employed. For example, glass to be employed can contain one or more of $B_2O_3$—$SiO_2$, BaO—$B_2O_3$, $SiO_2$—$B_2O_3$—CaO—BaO, $SiO_2$—ZnO—$B_2O_3$, $SiO_2$—$B_2O_3$—$Li_2O$, and $SiO_2$—$B_2O_3$—$Li_2O$—BaO. Also, material used to form aggregate is not limited to glass, and various ceramic materials such as alumina may be employed. A mixture of glass and a ceramic material (e.g., alumina) may also be employed. In any case, preferably, material particles of aggregate have a flat shape. Through employment of such material particles, in manufacture of the resistor 170, in a step of applying force in a direction parallel to the center axis CL to material of the resistor 170 for compressing the material, minor axes of flat material particles can approach a direction parallel to the center axis CL, and major axes can approach a direction orthogonal to the center axis CL. As a result, zirconia segments P1 (FIG. 5) extending in a direction intersecting with the center axis CL can be easily formed. That is, the number NL1 of type 1 lines and the number NL2 of type 2 lines can be easily increased. Incidentally, the major axis of a flat particle defines the greatest outside diameter of the particle, and the minor axis of the flat particle defines the smallest outside diameter of the particle. In order to implement the number NL1 of type 1 lines which falls within the above-mentioned preferred range, preferably, the aspect ratios (length of the major axis (greatest outside diameter): length of the minor axis (smallest outside diameter)) of material particles of aggregate fall within a range of "1:0.4" to "1:0.7."

The numbers NL1 and NL2 of lines can be easily adjusted by adjusting the aspect ratios of material particles of aggregate and the crushability of material particles (particularly glass particles) of aggregate. For example, by means of increasing the length of the major axis in relation to the length of the minor axis, the numbers NL1 and NL2 of lines can be increased. Also, by means of rendering glass particles easily crushable, the numbers NL1 and NL2 of lines can be increased.

Also, the average lateral continuation value NccA can be easily adjusted by adjusting the aspect ratio of material particles of aggregate, the crushability of material particles (particularly glass particles) of aggregate, and the percentage (e.g., % by mass) of a filler material and the percentage of an electrically conductive material in a material of the resistor 170. For example, the average lateral continuation value NccA can be increased by means of increasing the percentage of a filler material and the percentage of an electrically conductive material while increasing the length of the major axis of material particles of aggregate in relation to the length of the minor axis of the material particles. Also, the average lateral continuation value NccA can be increased by means of increasing the percentage of a filler material and the percentage of an electrically conductive material while rendering glass particles easily crushable. By means of increasing the average lateral continuation value NccA in this manner, the average lateral continuation value NccA greater than the expected lateral continuation value NccE can be implemented.

(2) The shape of the resistor 170 is not limited to a substantially circular columnar shape, and any shape can be employed. For example, the through hole 112 of the insulator 110 may include a portion whose inside diameter changes in the forward direction D1, and the resistor 170 may be formed in the portion whose inside diameter changes. In this case, the resistor 170 includes a portion whose outside diameter changes in the forward direction D1. Presumably, radio noise evaluation and under-load life evaluation are greatly influenced by that portion of the resistor 170 whose outside diameter is small. Therefore, generally, it is preferred that the smallest outside diameter of that portion of the resistor 170 which is in contact with the entire inner circumference of the through hole 112 of the insulator 110 in a section taken perpendicular to the axial line CL, falls within the above-mentioned preferred range of the resistor diameter 70D.

In any case, if the number NL1 of type 1 lines calculated by use of the object region A10 disposed at at least one position on a section of the resistor 170 which contains the center axis CL, falls within the above-mentioned preferred range, the number NL1 of type 1 lines of the resistor 170 can be said to fall within the preferred range. If the number NL1 of type 1 lines of the resistor 170 falls within the preferred range, presumably, resistor life and restraint of radio noise can be improved. The same also applies to the number NL2 of type 2 lines.

(3) The configuration of the spark plug is not limited to that having been described with reference to FIG. 4, and various configurations can be employed. For example, a noble metal tip may be provided at that portion of the ground electrode 130 which is used to define the gap g. Various materials which contain a noble metal such as iridium or platinum can be employed for forming a noble metal tip. Similarly, a noble metal tip may be provided at that portion of the center electrode 120 which is used to define the gap g.

(4) There may be combined a configuration selected arbitrarily from various configurations of the spark plug 1 which have been described with reference to FIGS. 1 to 3 and Tables 1 to 3, and a configuration selected arbitrarily from various configurations of the spark plug 100 which have been described with reference to FIGS. 4 and 5 and Tables 4 and 5. For example, the following configurations 1 to 8 can be derived from the techniques which have been described with reference to FIGS. 1 to 3 and Tables 1 to 3. Also, for example, the following configurations 10 to 18 can be derived from the techniques which have been described with reference to FIGS. 4 and 5 and Tables 4 and 5. Incidentally, there may be combined one or more configurations selected arbitrarily from configurations 1 to 8, and one or more configurations selected arbitrarily from configurations 10 to 18. In the case of such combination of a plurality of configurations, at least the advantages of the combined individual configurations can be implemented. For example, configuration 9 mentioned below is a combination of configuration 10 and one configuration selected from configurations 1 to 8. Configuration 9 can implement at least the advantage of configuration 1 and the advantage of configuration 10.

Configuration 1. A spark plug of the present configuration comprises an insulator having an axial hole extending therethrough along an axial line, a center electrode inserted into a forward end side of the axial hole, a terminal electrode inserted into a rear end side of the axial hole, and an interelectrode insert which contains glass and electrically conductive carbon and is disposed in the axial hole between the center electrode and the terminal electrode, and is characterized in that the interelectrode insert has a carbon content of 1.5% by mass to 4.0% by mass at a forward portion located forward of a center point along the axial line between a rear end of the center electrode and a forward end of the terminal electrode, the interelectrode insert has a resistance of 1.0 kΩ, to 3.0 kΩ, and the forward portion is lower in resistance than a rear portion of the interelectrode insert located rearward of the center point along the axial line between the rear end of the center electrode and the forward end of the terminal electrode.

According to the above configuration 1, the interelectrode insert has a resistance of 1.0 kΩ or more, and, upon application of voltage to the center electrode, relatively large current flows through the interelectrode insert. Therefore, particularly, at the forward portion of the interelectrode insert which has a high temperature, abrupt oxidation of electrically conductive paths formed of carbon is of concern.

In this connection, according to the above configuration 1, a forward portion of the interelectrode insert has a carbon content of 1.5% by mass or more. Therefore, electrically conductive paths formed in the forward portion can be sufficiently thick, so that, at the time of application of electricity, heat generated in the electrically conductive paths can be reduced. As a result, oxidation of the electrically conductive paths can be effectively restrained.

Furthermore, according to the above configuration 1, the carbon content is 4.0% by mass or less and is thus restrained to such an extent as to be able to sufficiently restrain cohesion of carbon. Therefore, at the forward portion, a sufficient number of the electrically conductive paths can be formed. As a result, there can be reliably prevented a situation in which oxidation of a mere portion of the electrically conductive paths leads to an abrupt increase in the resistance of the forward portion (interelectrode insert). Particularly, the forward portion of the interelectrode insert is apt to be subjected to heat from a combustion chamber; thus, specifying the carbon content of the forward portion is quite effective. According to the above configuration 1, not only is controlled to 3.0 kΩ or less the resistance, but also the carbon content is specified, whereby durability can be effectively improved.

Notably, if the carbon content is excessively increased, the electrically conductive paths will increase, but the resistance will lower (durability deteriorates). In the present embodiment, a required resistance is attained by relatively reducing the glass content and reducing the carbon content per unit area (reducing carbon density). However, if the glass content is excessively low, increasing the density of the interelectrode insert through deformation of glass will become insufficient, potentially resulting in a failure to implement good durability. Also, if the carbon content is excessively low, the number of the electrically conductive paths having high carbon density will become small, potentially resulting in a failure to implement good durability.

Furthermore, according to the above configuration 1, in the interelectrode insert, the forward portion is lower in resistance than the rear portion. Therefore, at the time of application of electricity, heat generated at the forward portion can be further reduced. As a result, oxidation of the electrically conductive paths can be more effectively restrained.

As mentioned above, according to the above configuration 1, at the forward portion which is apt to have a high temperature and in which oxidation of the electrically conductive paths is of greater concern, oxidation of the electrically conductive paths can be very effectively restrained; and, even when the electrically conductive paths are partially oxidized, an abrupt increase in resistance can be more reliably prevented. As a result, an excellent under-load life characteristic can be more reliably implemented for a spark plug which encounters difficulty in securing a good under-load life characteristic because of a resistance of the interelectrode insert of 1.0 kΩ to 3.0 kΩ.

Configuration 2. A spark plug of the present configuration is characterized in that, in the above configuration 1, the forward portion has a resistance of 0.30 kΩ to 0.80 kΩ.

At the initial stage of spark discharge, charge stored in capacitance sections such as the spark plug and cables connected to the spark plug flows abruptly to the gap formed between the center electrode and the ground electrode, thereby generating capacitive discharge. This capacitive discharge generates noise.

According to the above configuration 2, since the resistance of the forward portion is specified as 0.30 kΩ or more, at the time of spark discharge, there can be effectively restrained an abrupt flow, to the gap, of charge stored at an axial position in the spark plug where the interelectrode insert exists. As a result, capacitive discharge current can be sufficiently reduced, whereby a good noise restraining effect can be yielded.

Also, according to the above configuration 2, the resistance of the forward portion is specified as 0.80 kΩ or less. Therefore, at the time of application of electricity, the generation of heat at the forward portion can be further restrained. As a result, oxidization of electrically conductive paths can be more effectively restrained, whereby an excellent under-load life characteristic can be implemented.

Configuration 3. A spark plug of the present configuration is characterized in that, in the above configuration 1 or 2, the forward portion has a resistance of 0.35 kΩ to 0.65 kΩ.

According to the above configuration 3, the resistance of the forward portion is specified as 0.45 kΩ or more. Therefore, capacitive discharge current can be further reduced, whereby a noise restraining effect can be further enhanced.

Also, since the resistance of the forward portion is specified as 0.65 kΩ or less, the generation of heat of electrically conductive paths at the forward portion can be further restrained. As a result, oxidization of the electrically conductive paths can be further restrained, whereby an under-load life characteristic can be further improved.

Configuration 4. A spark plug of the present configuration is characterized in that, in any one of the above configurations 1 to 3, the resistance of the forward portion is 22% to 43% that of the interelectrode insert.

According to the above configuration 4, the resistance of the forward portion is specified as 22% to 43% that of the interelectrode insert. Therefore, the effect of restraining the generation of heat of electrically conductive paths formed in the forward portion and the effect of reducing capacitive discharge current can be improved in balance.

Configuration 5. A spark plug of the present configuration is characterized in that, in any one of the above configurations 1 to 4, the interelectrode insert comprises a resistor which contains the glass and the carbon, and a forward seal disposed between the resistor and the center electrode, a distance along the axial line from a rear end of the forward seal to the rear end of the center electrode is 1.7 mm or more, and a distance along the axial line from a portion of the forward seal in contact with a forward end of the resistor to the rear end of the center electrode is 0.2 mm or more.

Generally, the forward seal is formed as follows: while a pressing force is applied from the terminal electrode to a glass powder mixture, which is a material for the seal, the glass powder mixture is heated and fired. Therefore, the rear end surface of the forward seal is curved concave forward. Thus, the rear end of the forward seal is located at the outer circumference of the forward seal (in the vicinity of the inner circumferential surface of the insulator).

Also, when electric current flows through the resistor, electric current is particularly likely to flow through an outer circumferential portion of the resistor (a portion located in the vicinity of the inner circumferential surface of the insulator). Therefore, by means of restraining oxidation of electrically conductive paths in an outer circumferential portion of the resistor, an under-load life characteristic can be further improved.

In light of this, according to the above configuration 5, the distance along the axial line from the rear end of the forward seal to the rear end of the center electrode is specified as 1.7 mm or more. Therefore, that outer circumferential portion of the resistor through which electric current is particularly likely to flow can be located greatly away from the gap (combustion chamber). Thus, at the time of combustion, an outer circumferential portion of the resistor can be greatly reduced in the amount of received heat, whereby oxidation of electrically conductive paths in the outer circumferential portion of the resistor can be more reliably restrained. As a result, an under-load life characteristic can be further improved.

Furthermore, according to the above configuration 5, the distance along the axial line from a portion of the forward seal in contact with the forward end of the resistor (forward-most portion of the resistor) to the rear end of the center electrode is specified as 0.2 mm or more. Therefore, the entire resistor can be located sufficiently away from the gap (combustion chamber). Thus, at the time of combustion, the resistor can be further reduced in the amount of received heat, whereby oxidation of electrically conductive paths can be more reliably restrained. As a result, an under-load life characteristic can be further improved.

Configuration 6. A spark plug of the present configuration is characterized in that, in any one of the above configurations 1 to 5, the interelectrode insert comprises a resistor which contains the glass and the carbon, and a forward seal disposed between the resistor and the center electrode, a distance along the axial line from a rear end of the forward seal to the rear end of the center electrode is 3.7 mm or less, and a distance along the axial line from a portion of the forward seal in contact with a forward end of the resistor to the rear end of the center electrode is 1.5 mm or less.

According to the above configuration 6, the distance along the axial line from the rear end of the forward seal to the rear end of the center electrode is specified as 3.7 mm or less such that an outer circumferential portion of the resistor is located close to the center electrode to a certain extent. Therefore, a portion of the spark plug located forward of the outer circumferential portion of the resistor can be rendered short; eventually, charge stored at the portion (charge which is applied to the gap without passage through the resistor at the time of spark discharge) can be sufficiently reduced. As a result, capacitive discharge current can be further reduced, whereby the noise restraining effect can be further enhanced.

Furthermore, according to the above configuration 6, the distance along the axial line from a portion of the forward seal in contact with the forward end of the resistor (forward-most portion of the resistor) to the rear end of the center electrode is specified as 1.5 mm or less. Therefore, charge which is applied to the gap without passage through the resistor can be more reduced. As a result, capacitive discharge current can be further reduced, whereby the noise restraining effect can be further improved.

Configuration 7. A spark plug of the present configuration is characterized in that, in any one of the above configurations 1 to 6, the axial hole has an inside diameter of 3.5 mm or less at a forward end of a range in which only the interelectrode insert exists within the axial hole in a section taken orthogonal to the axial line.

In recent years, demand has arisen to reduce the size of a spark plug; in this connection, in some cases, that portion of the axial hole in which the interelectrode insert is disposed has a relatively small inside diameter. However, in the case of employment of such a small inside diameter, pressure is unlikely to be applied to a forward portion of the resistor (resistor composition). Accordingly, the density of the resistor is apt to reduce (a reduction of density of the resistor means a reduction of the number of electrically conductive paths); consequently, an under-load life characteristic is apt to deteriorate.

In this connection, through employment of the above configuration 1, etc., even in the case where, as in the case of the above configuration 7, the axial hole has an inside diameter of 3.5 mm or less at the forward end of the range in which only the interelectrode insert exists in the axial hole, the density of the resistor can be sufficiently increased, whereby a good under-load life characteristic can be implemented. In other words, the above configuration 1, etc., are particularly useful for a spark plug in which the above-mentioned inside diameter is 3.5 mm or less.

Configuration 8. A spark plug of the present configuration is characterized in that, in the above configuration 7, the axial hole has an inside diameter of 2.9 mm or less.

In the case where, as in the case of the above configuration 8, the axial hole has an inside diameter of 2.9 mm or less at the forward end of the range in which only the interelectrode insert exists in the axial hole, a reduction of density of the resistor is of great concern; however, through employment of the above configuration 1, etc., such concern can be wiped out, whereby a good under-load life characteristic can be obtained. In other words, the above configuration 1, etc., are quite effective for a spark plug in which the above-mentioned inside diameter is 2.9 mm or less.

Configuration 9. A spark plug of the present configuration is characterized in that, in any one of the above configurations 1 to 8, the interelectrode insert includes a resistor, the resistor contains aggregate, $ZrO_2$-containing filler, and carbon, and in a section of the resistor which contains the axial line, the total number of lateral linear regions each having two or more said type 1 regions is five or more, where an object region is a rectangular region having the axial line as a center line and having a size of 1,800 μm perpendicular to the axial line and a size of 2,400 μm along the axial line, the object region is divided into a plurality of square regions having a side length of 200 μm, and lateral linear regions each consist of nine square regions arrayed in a direction perpendicular to the axial line, a type 1 region is a square region having an area percentage of $ZrO_2$ of 25% or more, and a type 2 region is a square region having an area percentage of $ZrO_2$ of less than 25%.

According to the above configuration 9, through establishment of proper internal conditions of the resistor, both restraint of radio noise and life of the resistor can be improved.

Configuration 10. A spark plug comprising:

an insulator having a through hole extending along an axial line;

a center electrode at least a portion of which is inserted into a forward portion of the through hole;

a metal terminal member at least a portion of which is inserted into a rear portion of the through hole; and a connection for electrically connecting the center electrode and the metal terminal member in the through hole;

wherein the connection includes a resistor;

the resistor contains aggregate, $ZrO_2$-containing filler, and carbon; and in a section of the resistor which contains the axial line, the total number of lateral linear regions each having two or more said type 1 regions is five or more, where an object region is a rectangular region having the axial line as a center line and having a size of 1,800 μm perpendicular to the axial line and a size of 2,400 μm along the axial line, the object region is divided into a plurality of square regions having a side length of 200 μm, and lateral linear regions each consist of nine square regions arrayed in a direction perpendicular to the axial line, a type 1 region is a square region having an area percentage of $ZrO_2$ of 25% or more, and a type 2 region is a square region having an area percentage of $ZrO_2$ of less than 25%.

According to this configuration, through establishment of proper internal conditions of the resistor, both restraint of radio noise and the life of the resistor can be improved.

Configuration 11. A spark plug according to configuration 10, wherein the total number of the lateral linear regions each having two or more consecutive said type 1 regions is five or more.

According to this configuration, through establishment of proper internal conditions of the resistor, both restraint of radio noise and the life of the resistor can be improved.

Configuration 12. A spark plug according to configuration 10 or 11, wherein the filler contains $TiO_2$, and the mass ratio of Ti to Zr in the resistor is 0.05 to 6.

According to this configuration, through establishment of a proper mass ratio of Ti to Zr in the filler, both restraint of radio noise and the life of the resistor can be improved.

Configuration 13. A spark plug according to any one of configurations 10 to 12, wherein the smallest outside diameter of that portion of the resistor which is in contact with the entire inner circumference of the insulator in a section taken perpendicular to the axial line, is 3.5 mm or less.

According to this configuration, in the case of use of a resistor having an outside diameter of 3.5 mm or less, both restraint of radio noise and the life of the resistor can be improved.

Configuration 14. A spark plug according to configuration 13, wherein the smallest outside diameter is 2.9 mm or less.

According to this configuration, in the case of use of a resistor having an outside diameter of 2.9 mm or less, both restraint of radio noise and the life of the resistor can be improved.

Configuration 15. A spark plug according to any one of configurations 10 to 14, wherein a distance along the axial line between a rear end of the center electrode and a forward end of the metal terminal member is 15 mm or more.

According to this configuration, in the case where the resistor is disposed between the center electrode and the metal terminal member which are disposed 15 mm or more apart from each other, both restraint of radio noise and the life of the resistor can be improved.

Configuration 16. A spark plug according to any one of configurations 10 to 15, wherein, if a linear region consisting of 12 said square regions arrayed in parallel with the center axis is defined as a longitudinal linear region, and a greatest number of consecutive said type 1 regions in one longitudinal linear region is defined as a maximum longitudinal continuation number, the average of the maximum longitudinal continuation numbers of nine longitudinal linear regions contained in the object region is 5.0 or less.

According to this configuration, restraint of radio noise can be further improved.

Configuration 17. A spark plug according to any one of configurations 10 to 16, wherein the total number of the lateral linear regions each having two or more consecutive said type 1 regions is seven or more.

According to this configuration, the life of the resistor can be further improved.

Configuration 18. A spark plug according to any one of configurations 10 to 17, wherein, if a greatest number of consecutive said type 1 regions in one lateral linear region is defined as a maximum lateral continuation number, the average of the maximum lateral continuation numbers of 12 lateral linear regions contained in the object region is greater than an expected value of the maximum lateral continuation number calculated from the total number of the type 1 regions in the object region.

According to this configuration, the life of the resistor can be further improved.

The present invention has been described with reference to the above embodiments and modifications. However, the embodiments and modifications are meant to help understand the invention, but are not meant to limit the invention. The present invention may be modified or improved without departing from the gist and the scope of the invention and encompasses equivalents of such modifications and improvements.

INDUSTRIAL APPLICABILITY

The present disclosure can be favorably utilized for a spark plug for use in an internal combustion engine, etc.

DESCRIPTION OF REFERENCE NUMERALS

1: spark plug;
2: ceramic insulator (insulator);
4: axial hole;
5: center electrode;
6: terminal electrode;
7: resistor;
8A: forward seal;
9: interelectrode insert;
9A: forward portion;
9B: rear portion;
CL1: axial line;
CP: center point;
105: gasket;
106: first rear packing;
107: second rear packing;
108: forward packing;
109: talc;
110: insulator (ceramic insulator);
111: second outside diameter reducing portion;
112: through hole (axial hole);
113: leg portion;
114: rear opening;
115: first outside diameter reducing portion;
116: inside diameter reducing portion;
117: forward trunk portion;
118: rear trunk portion;
119: collar portion;
120: center electrode;
121: outer layer;
122: core;
123: head portion;
124: collar portion;
125: leg portion;
129: forward end surface;
130: ground electrode;
131: distal end portion;
135: base metal;
136: core;
140: metal terminal member;
150: metallic shell;
151: tool engagement portion;
152: threaded portion;
153: crimped portion;
154: seat portion;
155: trunk portion;
156: inside diameter reducing portion;
158: deformed portion;
159: through hole;
160: first seal;
170: resistor;
70D: outside diameter (resistor diameter);
70L: resistor length;
180: second seal;
100: spark plug;
300: connection;
300L: connection length;
400: fragmentary section;
g: gap;
R: component ratio;
D1: forward direction;
D1*r*: rearward direction;
A1: type 1 region;
A2: type 2 region;
CL: center axis (axial line);
Ac: electrically conductive region;
Nc: number of type 1 regions;
Aa: aggregate region;
Pg: segment;
P3: balance segment;
P2: titania segment;
P1: zirconia segment;
A10: object region;
L01 to L12: lateral linear region;
La: first length;
A20: square region;
Lb: second length;
NL1: number of type 1 lines;
NL2: number of type 2 lines; and
Ncc: maximum continuation number.

Having described the invention, the following is claimed:

1. A spark plug comprising:

an insulator having an axial hole extending therethrough along an axial line;

a center electrode inserted into a forward end side of the axial hole;

a terminal electrode inserted into a rear end side of the axial hole; and an interelectrode insert which contains glass and electrically conductive carbon and is disposed in the axial hole between the center electrode and the terminal electrode;

the spark plug being characterized in that the interelectrode insert has a carbon content of 1.5% by mass to 4.0% by mass at a forward portion located forward of a center point along the axial line between a rear end of the center electrode and a forward end of the terminal electrode;

the interelectrode insert has a resistance of 1.0 kΩ to 3.0 kΩ; and the forward portion is lower in resistance than a rear portion of the interelectrode insert located rearward of the center point along the axial line between the rear end of the center electrode and the forward end of the terminal electrode.

2. The spark plug according to claim 1, wherein the forward portion has a resistance of 0.30 kΩ to 0.80 kΩ.

3. The spark plug according to claim 2, wherein the forward portion has a resistance of 0.35 kΩ to 0.65 kΩ.

4. The spark plug according to claim 1, wherein the resistance of the forward portion is 22% to 43% that of the interelectrode insert.

5. The spark plug according to claim 1, wherein the interelectrode insert comprises a resistor which contains the glass and the carbon, and a forward seal disposed between the resistor and the center electrode;

a distance along the axial line from a rear end of the forward seal to the rear end of the center electrode is 1.7 mm or more; and a distance along the axial line from a portion of the forward seal in contact with a forward end of the resistor to the rear end of the center electrode is 0.2 mm or more.

6. The spark plug according to claim 1, wherein the interelectrode insert comprises a resistor which contains the glass and the carbon, and a forward seal disposed between the resistor and the center electrode;

a distance along the axial line from a rear end of the forward seal to the rear end of the center electrode is 3.7 mm or less; and a distance along the axial line from a portion of the forward seal in contact with a forward end of the resistor to the rear end of the center electrode is 1.5 mm or less.

7. The spark plug according to claim 1, wherein the axial hole has an inside diameter of 3.5 mm or less at a forward end of a range in which only the interelectrode insert exists within the axial hole in a section taken orthogonal to the axial line.

8. The spark plug according to claim 7, wherein the axial hole has an inside diameter of 2.9 mm or less.

9. The spark plug according to claim 1, wherein the interelectrode insert includes a resistor;

the resistor contains aggregate, $ZrO_2$-containing filler, and carbon; and in a section of the resistor which contains the axial line, the total number of lateral linear regions each having two or more type 1 regions is five or more, where an object region is a rectangular region having the axial line as a center line and having a size of 1,800 μm perpendicular to the axial line and a size of 2,400 μm along the axial line, the object region is divided into a plurality of square regions having a side length of 200 μm, and the lateral linear regions each consist of nine square regions arrayed in a direction perpendicular to the axial line, a type 1 region is a square region having an area percentage of $ZrO_2$ of 25% or more, and a type 2 region is a square region having an area percentage of $ZrO_2$ of less than 25%.

* * * * *